US010241432B2

(12) United States Patent
Obara et al.

(10) Patent No.: US 10,241,432 B2
(45) Date of Patent: Mar. 26, 2019

(54) ELECTROSTATICALLY CHARGED IMAGE DEVELOPING TONER AND ELECTROSTATICALLY CHARGED IMAGE DEVELOPING TWO-COMPONENT DEVELOPER

(71) Applicant: Konica Minolta, Inc., Tokyo (JP)

(72) Inventors: Shinya Obara, Fuchu (JP); Satoshi Uchino, Hino (JP); Junya Ueda, Hino (JP); Takuya Takahashi, Higashimurayama (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/787,033

(22) Filed: Oct. 18, 2017

(65) Prior Publication Data

US 2018/0120721 A1 May 3, 2018

(30) Foreign Application Priority Data

Nov. 2, 2016 (JP) ..... 2016-214841

(51) Int. Cl.

| | |
|---|---|
| ***G03G 9/087*** | (2006.01) |
| ***G03G 9/097*** | (2006.01) |
| ***G03G 9/083*** | (2006.01) |
| ***G03G 9/08*** | (2006.01) |

(52) U.S. Cl.

CPC ..... *G03G 9/08797* (2013.01); *G03G 9/0823* (2013.01); *G03G 9/0833* (2013.01); *G03G 9/08755* (2013.01); *G03G 9/08795* (2013.01); *G03G 9/09708* (2013.01); *G03G 9/09716* (2013.01); *G03G 9/09725* (2013.01)

(58) Field of Classification Search

CPC ..... G03G 9/08797; G03G 9/0833; G03G 9/0823; G03G 9/08755; G03G 9/09725

See application file for complete search history.

(56) References Cited

U.S. PATENT DOCUMENTS

| | | | | |
|---|---|---|---|---|
| 6,348,291 | B1 * | 2/2002 | Sato | G03G 9/09708 430/108.6 |
| 2005/0014079 | A1 * | 1/2005 | Itakura | G03G 9/0821 430/45.4 |
| 2007/0217842 | A1 * | 9/2007 | Kato | G03G 9/0821 399/350 |

FOREIGN PATENT DOCUMENTS

JP 2002214827 A 7/2002

* cited by examiner

*Primary Examiner* — Thorl Chea

(74) *Attorney, Agent, or Firm* — Lucas & Mercanti, LLP

(57) ABSTRACT

An electrostatically charged image developing toner includes a particulate toner matrix containing an external additive on the surface of the particulate toner matrix. The external additive includes silica particles A and silica particles B. The silica particles A have a number average primary-particle diameter in the range of 40 to 100 nm and an average circularity in the range of 0.50 to 0.90, and are surface-modified with silicone oil. The silica particles B have a number average primary-particle diameter of 25 nm or more and smaller than the number average primary-particle diameter of the silica particles A, and are surface-modified with alkylalkoxysilane having a specific structure or silazane.

11 Claims, 1 Drawing Sheet

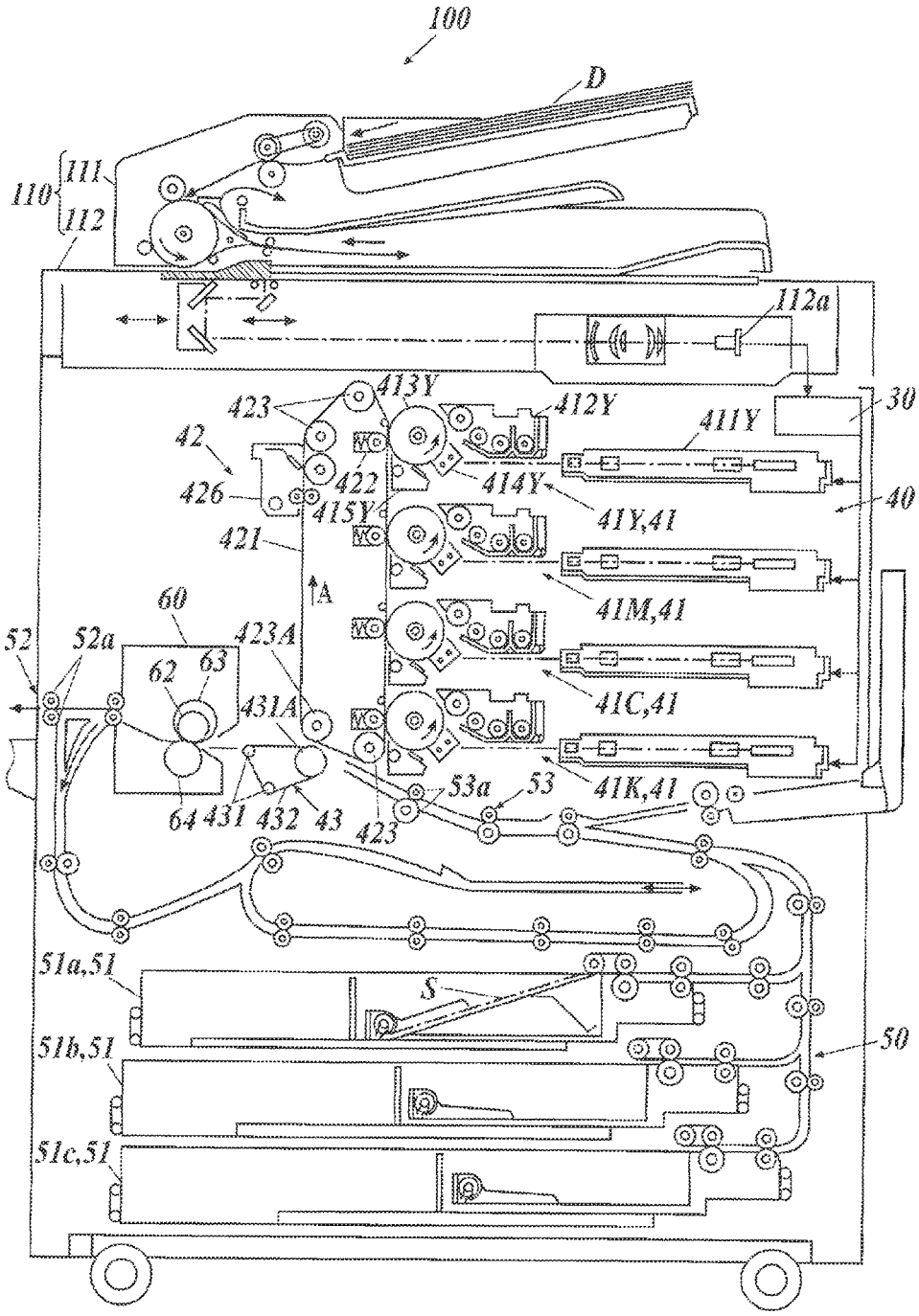
100
D
110
111
112
112a
30
40
423
413Y
412Y
411Y
42
426
422
414Y
415Y
41Y,41
421
A
41M,41
60
52
52a
423A
62
63
41C,41
431A
41K,41
53a
53
64
431
432
43
423
51a,51
S
50
51b,51
51c,51

ELECTROSTATICALLY CHARGED IMAGE DEVELOPING TONER AND ELECTROSTATICALLY CHARGED IMAGE DEVELOPING TWO-COMPONENT DEVELOPER

CROSS-REFERENCE TO RELATED APPLICATIONS

This application claims a priority under the Paris Convention of Japanese patent application No. 2016-214841 filed on Nov. 2, 2016, the entire disclosure of which is incorporated herein by reference in its entirety.

BACKGROUND

Technological Field

The present invention relates to electrostatically charged image developing toners and electrostatically charged image developing two-component developers. More specifically, the present invention relates to an electrostatically charged image developing toner and an electrostatically charged image developing two-component developer that have high transfer characteristics to embossed paper, enable output of images with high graininess, and can reduce image defects caused by escape of an external additive during continuous printing of images having high coverage rates.

Description of the Related Art

Along with spread of copiers and printers, higher performance of toner has been required. Recent attention has been paid to a digital printing technique called print on demand (POD) to perform direct printing without a plate making step. The print on demand (POD) is advantageous over conventional offset printing because the POD technique can cover small-lot printing and variable printing to print while the content is variable for each of sheets.

Significances in application of an electrophotographic image forming process to the POD field are not only efficiencies, such as high print rate and low running cost, but also stability over a variety of coverage rates and output of high-definition images irrespective of the type of the recording paper.

In particular, the field of graphic art these days often uses embossed sheets, i.e., thick recording media having surface irregularities. These surface irregularities of recording media preclude sufficient transfer of toners, resulting in defects in images.

To solve these problems, for example, a toner is disclosed that is prepared by a sol-gel process, and has large diameter and high sphericity. The toner contains a large amount of the external additive and exhibits reduced electrostatic and physical adhesive force to a transfer member and improved transfer characteristics (for example, Japanese Patent Application Laid-Open No. 2002-214827).

Unfortunately, while the toner has improved transfer characteristics, the adhesive force between toner particles is reduced; as a result, the toner particles readily scatter, resulting in rough images (with low graininess). Usually, the residual toner and the external additive adhering to the surface of a photoreceptor are scraped by the distal end of the cleaning blade to remove the residual toner and the external additive. The addition of a large amount of external additive having a large diameter and a high sphericity may readily cause partial escape of the external additive, causing local abrasion of the photoreceptor and generation of image defects caused by contamination of machine parts.

SUMMARY

The present invention has been made in consideration of the problems and the circumstances. An object of the present invention is to provide an electrostatically charged image developing toner and an electrostatically charged image developing two-component developer that have high transfer characteristics to embossed paper, enable output of images with high graininess, and can reduce image defects attributed to escape of an external additive during continuous printing of images having high coverage rates.

The present inventors, who have conducted extensive research to solve the problems, have found that a toner containing external additives including silica particles A having a number average primary-particle diameter and an average circularity in predetermined ranges and surface-modified with silicone oil, and silica particles B having a diameter smaller than that of the silica particles A and surface-modified with alkylalkoxysilane or silazane can have high transfer characteristics to embossed paper, enables output of images with high graininess, and can reduce image defects attributed to escape of the external additives. The present invention is thereby completed.

In other words, the problems of the present invention are solved by the following aspects.

To achieve at least one of the abovementioned objects, according to an aspect of the present invention, an electrostatically charged image developing toner including a particulate toner matrix containing an external additive on the surface of the particulate toner matrix, wherein the external additive includes silica particles A and silica particles B, the silica particles A have a number average primary-particle diameter in the range of 40 to 100 nm and an average circularity in the range of 0.50 to 0.90, and are surface-modified with silicone oil, and the silica particles B have a number average primary-particle diameter of 25 nm or more and smaller than the number average primary-particle diameter of the silica particles A, and are surface-modified with alkylalkoxysilane having a structure represented by Formula (1) or silazane:

$$R_1—S(OR_2)_3 \qquad \text{Formula (1)}$$

where $R_1$ represents a linear alkyl group having 1 or more and 10 or less carbon atoms and has an optional substituent; $R_2$ represents a methyl or ethyl group.

BRIEF DESCRIPTION OF THE DRAWING

The advantages and features provided by one or more embodiments of the invention will become more fully understood from the detailed description given hereinbelow and the appended drawings which are given by way of illustration only, and thus are not intended as a definition of the limits of the present invention.

FIG. 1 is a schematic view illustrating an example image forming apparatus.

DETAILED DESCRIPTION OF EMBODIMENTS

Hereinafter, one or more embodiments of the present invention will be described with reference to the drawings. However, the scope of the invention is not limited to the disclosed embodiments.

The aspects of the present invention can provide an electrostatically charged image developing toner that has high transfer characteristics to embossed paper, enables output of images with high graininess, and can reduce image defects attributed to escape of the external additives during continuous printing of images having high coverage rates.

The present inventor infers the following expression mechanism or action mechanism of the advantageous effects of the present invention although the mechanism is not clarified.

The toner according to the present invention contains an external additive of silica particles A surface-modified with silicone oil. It is believed that the silica particles A facilitate release of the toner from an intermediate transfer member (transfer belt) during transfer of a toner layer from the transfer belt onto embossed paper, resulting in improved transfer characteristics of the toner layer to the irregularities of the embossed paper having a weak transfer electric field.

Besides the silica particles A, the toner according to the present invention further contains another external additive of silica particles B surface-modified with alkoxysilane or silazane. It is believed that the silica particles B generate appropriate interaction between toner particles to adjust the intermolecular force; the resulting toner barely scatters, and enables output of images with high graininess.

In this specification, the silica particles A have diameters larger than those of the silica particles B. For this reason, the silica particles A, rather than the silica particles B, preferentially come into contact with the intermediate transfer member (transfer belt), effectively demonstrating the advantageous effects in the toner containing the silica particles A. Because the silica particles B present between toner particles demonstrate their advantageous effects, the advantageous effects of the present invention can be effectively demonstrated by such silica particles B having diameters smaller than those of the silica particles A.

In addition, the silica particles A have an average circularity of 0.50 to 0.90. This value indicates low circularity and large surface area of the particles. Such silica particles A can have increased contact areas with a particulate toner matrix, and barely drop off from the particulate toner matrix. If the silica particles A having low circularity drop off from the particulate toner matrix, the silica particles A barely escape from a cleaning blade because of their low fluidity, reducing the image defects attributed to the escape of the external additive.

The electrostatically charged image developing toner according to the present invention includes a particulate toner matrix containing an external additive on the surface thereof, and the external additive includes silica particles A and silica particles B. The silica particles A have a number average primary-particle diameter in the range of 40 to 100 nm and an average circularity in the range of 0.50 to 0.90, and are surface-modified with silicone oil. The silica particles B have a number average primary-particle diameter of 25 nm or more and smaller than that of the silica particles A, and are surface-modified with alkylalkoxysilane having a structure represented by Formula (1) or silazane. Such a concept is a technical feature common to the following embodiments.

In a preferred embodiment of the present invention, the silica particles B are surface-modified with alkylalkoxysilane having a structure represented by Formula (1), and $R_1$ in Formula (1) has 4 or more and 8 or less carbon atoms to cause appropriate interaction between toner particles.

In a preferred embodiment of the present invention, the silica particles B are surface-modified with the silazane, and the silazane contained is hexamethyldisilazane or hexaethyldisilazane to generate appropriate interaction between toner particles.

In a preferred embodiment of the present invention, the external additive further includes titanium oxide nanoparticles having an average aspect ratio in the range of 2 to 15, the average aspect ratio being the ratio of the number average major diameter to the number average miner diameter. Such titanium oxide nanoparticles having a large average aspect ratio have large contact areas and barely migrate on the surface of the particulate toner matrix. Accordingly, the toner particles can keep a uniform coating of titanium oxide even under strong stress caused by continuous stirring in a developer container. A toner containing titanium oxide can effectively demonstrate the advantageous effects, such as control of the charging characteristics.

In a preferred embodiment of the present invention, the titanium oxide nanoparticles have a rutile crystal structure. Rutile titanium oxide has a higher calcination temperature and a smaller amount of surface hydroxy groups than those of anatase titanium oxide. Such features of rutile titanium oxide can protect the toner from influences of humidity, ensuring sufficient resistance independent of its surrounding environment. Accordingly, a toner containing such rutile titanium oxide nanoparticles as an external additive can demonstrate higher environmental stability of the charge amount.

In a preferred embodiment of the present invention, the particulate toner matrix includes a binder resin containing at least a crystalline resin to improve the low-temperature fixing characteristics of the toner.

In a preferred embodiment of the present invention, the silicone oil is dimethylsilicone oil in view of cost and easiness in handling.

In a preferred embodiment of the present invention, the particulate toner matrix contains an amorphous vinyl resin because the thermoplasticity is readily controlled.

In a preferred embodiment of the present invention, the crystalline resin contains a crystalline polyester resin to improve the low-temperature fixing characteristics of the toner.

The toner according to the present invention can be suitably used as an electrostatically charged image developing two-component developer including the toner and carrier particles.

The present invention and its constituent and embodiments for achieving the present invention will now be described in detail.

Throughout the specification "to" between two numerical values indicates the lower limit includes the numeric value before "to" and the upper limit includes the numeric value after "to".

[Outline of Electrostatically Charged Image Developing Toner]

The electrostatically charged image developing toner according to the present invention (also simply referred to as "toner") includes a particulate toner matrix containing an external additive on the surface thereof, wherein the external additive includes silica particles A and silica particles B. The silica particles A have a number average primary-particle diameter in the range of 40 to 100 nm and an average circularity in the range of 0.50 to 0.90, and are surface-modified with silicone oil. The silica particles B have a number average of primary-particle diameter of 25 nm or more and smaller than that of the silica particles A, and are surface-modified with alkylalkoxysilane having a structure represented by Formula (1) or silazane:

$$R_1—Si(OR_2)_3 \quad \text{Formula (1)}$$

where $R_1$ represents a linear alkyl group that has 1 or more and 10 or less carbon atoms and has an optional substituent; $R_2$ represents a methyl or ethyl group.

In the present invention, the term "toner" refers to aggregation of "toner particles".

<Particulate Toner Matrix>

The particulate toner matrix according to the present invention preferably includes an amorphous resin and a crystalline resin as binder resins. Besides, the particulate toner matrix may contain other constitutional components, such as a colorant, a mold release agent (wax), and a charge control agent, when necessary.

In the specification, the particulate toner matrix containing an external additive is referred to as a toner particle.

<External Additive>

The electrostatically charged image developing toner according to the present invention includes two external additives of silica particles, i.e., silica particles A and silica particles B. The silica particles A and B can be prepared by a known process, such as a sol-gel process, a gas phase process, or a melting process.

The silica particles A and B may further contain other external additives when necessary.

<Silica Particles A and Silica Particles B>

(Number Average Primary-Particle Diameter)

The silica particles A have a number average primary-particle diameter in the range of 40 to 100 nm, preferably 60 to 90 nm. Silica particles A having a number average primary-particles diameter of 40 nm or more can demonstrate a spacer effect in the silica particles A entering the gap between the photoreceptor and the intermediate transfer member (intermediate transfer belt) to stabilize the contact pressure between the photoreceptor and the intermediate transfer member, preventing image defects attributed to filming. Silica particles A having a number average primary-particle diameter of 100 nm or less can enhance the adhesive strength to the particulate toner matrix, reducing drop-off of the silica particles A from the particulate toner matrix.

The silica particles B have a number average primary particle diameter of 25 nm or more and smaller than that of the silica particles A. Silica particles B having a number average primary-particle diameter of 25 nm or more are barely buried in the particulate toner matrix, and can stably demonstrate their advantageous effects. If the number average primary-particle diameter of the silica particles B is smaller than that of the silica particles A, the silica particles A, rather than the silica particles B, preferentially can contact the intermediate transfer member (transfer belt), effectively demonstrating the effect of improving the transfer characteristics in the toner containing the silica particles A.

(Determination of Number Average Primary Particle Diameter)

A photographic image captured with a scanning electron microscope (SEM) "JSM-7401F" (made by JEOL, Ltd.) is read with a scanner, and the external additive particles (silica particles) in the photographic image are binarized with an image analyzer LUZEX AP (made by NIRECO CORPORATION). The horizontal Feret diameters of 100 silica particles are calculated, and the average is defined as the number average primary particle diameter.

(Average Circularity)

In the specification, the term "average circularity" of the silica particles A or the silica particles B indicates a median in the circularity distribution of the silica particles A or B (primary particles).

The silica particles A have an average circularity in the range of 0.50 to 0.90, preferably 0.65 to 0.85. An average circularity of 0.50 or more can prevent a significant reduction in fluidity of the toner, and facilitate transfer of the toner layer during the transfer step, preventing the output of images with poor graininess. An average circularity of 0.90 or less can reduce drop-off of the silica particles A from the particulate toner matrix to improve the transfer stability of the toner, and can reduce the escape of the toner particles from the distal end of a cleaning member.

The silica particles B can have any average circularity. The preferred circularity is within the range of 0.70 to 1.00. Silica particles B having an average circularity in the range of 0.70 to 1.00 are uniformly applied onto the surface of the particulate toner matrix, facilitating the interaction between toner particles. Such interaction between toner particles can prevent scattering of the toner, resulting in images with high graininess.

(Determination of Average Circularity)

A photographic image captured with a scanning electron microscope (SEM) "JSM-7401F" (made by JEOL, Ltd.) is read with a scanner, and the external additive particles (silica particles) in the photographic image are binarized with an image analyzer LUZEX AP (made by NIRECO CORPORATION). The circularities of 100 silica particles are determined from the following expression to calculate the average circularity:

$$\text{Circularity}=(\text{circle equivalent perimeter of particle})/(\text{perimeter of particle})=[2\times(A\pi)^{1/2}]/PM$$

where A represents the projected area of a silica particle, and PM represents the perimeter of the silica particle. The average circularity is the 50% circularity in the cumulative frequency of the circularities of the 100 silica particles determined by the plane image analysis.

(Surface Modification of Silica Particles A)

The silica particles A according to the present invention are surface-modified with silicone oil. Known silicone oil can be used. Examples thereof include dimethylsilicone oil, alkyl-modified silicone oil, amino-modified silicone oil, carboxyl-modified silicone oil, epoxy-modified silicone oil, fluorine-modified silicone oil, alcohol-modified silicone oil, polyether-modified silicone oil, methylphenyl silicone oil, methylhydrogen silicone oil, mercapto-modified silicone oil, higher fatty acid-modified silicone oil, phenol-modified silicone oil, methacrylic acid-modified silicone oil, polyether-modified silicone oil, and methylstyryl-modified silicone oil. Among these silicone oils, preferred is dimethylsilicone oil in view of cost and ease of handling.

These silicone oils for surface modification can be used alone or in combination.

(Surface Modification of Silica Particles B)

The silica particles B according to the present invention are surface-modified with alkylalkoxysilane having a structure represented by Formula (1) or silazane.

The alkylalkoxysilane having a structure represented by Formula (1) will now be described.

$$R_1—Si(OR_2)_3 \quad \text{Formula (1)}$$

where $R_1$ represents a linear alkyl group that has 1 or more and 10 or less carbon atoms, and has an optional substituent. The linear alkyl group has more preferably 4 or more and 8 or less carbon atoms. Any substituent that can impart the advantageous effects of the present invention can be used. Examples thereof include methyl and ethyl groups. It is believed that linear alkyl groups for $R_1$ having 1 or more and 10 or less carbon atoms interact with each other to generate appropriate intermolecular force between external additives on the toner particles, reducing scattering of the toner particles and forming images with high graininess. A linear alkyl group for $R_1$ having 10 or less carbon atoms can prevent generation of significantly strong interactive force between toner particles or significantly high aggregation characteristics of the external additive.

$R_2$ represents a methyl or ethyl group. More preferred is the methyl group in view of reactivity because the silica particles are insufficiently surface-modified with a functional group $R_2$ having a bulky steric structure. If $R_2$ is a hydrogen atom, the compound represented by Formula (1) has a hydroxy group. Such a compound is undesirable because the compound has high chemical affinity with water to serve as a leakage point of the electrical charge under an environment at a high temperature and a high humidity.

Specific examples of the alkylalkoxysilane having a structure represented by Formula (1) include, but should not be limited to, $CH_3—(CH_2)_9—Si(OCH_3)_3$, $CH_3—(CH_2)_9—Si(OC_2H_5)_3$, $CH_3—(CH_2)_7—Si(OCH_3)_3$, $CH_3—(CH_2)_7—Si(OC_2H_5)_3$, $CH_3—(CH_2)_5—Si(OCH_3)_3$, $CH_3—(CH_2)_5—Si(OC_2H_5)_3$, $CH_3—(CH_2)_3—Si(OCH_3)_3$, $CH_3—(CH_2)_3—Si(OC_2H_5)_3$, $CH_3—CH_2—Si(OCH_3)_3$, and $CH_3—CH_2—Si(OC_2H_5)_3$.

Silazane will now be described. Known silazane can be used in the range not inhibiting the advantageous effects of the present invention. Preferred are hexamethyldisilazane and hexaethyldisilazane that can impart appropriate interactive force to toner particles to reduce scattering of the toner particles and form images with high graininess. Among these compounds, particularly preferred is hexamethyldisilazane.

The silica particles can be surface-modified with alkoxysilane or silazane (hereinafter, also referred to as "surface modifier") by any known dry or wet process.

In a preferred dry process, raw material silica particles and the surface modifier are stirred or mixed in a fluidized-bed layer reactor. In a preferred wet process, raw material silica particles are dispersed in a solvent to prepare a slurry of the raw material silica particles, and a surface modifier is added to the slurry to surface-modify the raw material silica particles.

In the dry or wet process, the raw material silica particles and the surface modifier are preferably heated at a temperature in the range of 100 to 200° C. for 0.5 to 5 hours. Such a heat treatment results in effective modification of the surface silanol groups of the raw material silica particles. The surface modifier can be used in any amount. The surface modifier is used in an amount of preferably 5 to 30 parts by mass, more preferably 8 to 20 parts by mass relative to 100 parts by mass of raw material silica particles.

(Contents of Silica Particles A and Silica Particles B)

The toner according to the present invention preferably contains 0.1 to 1.5 mass % of silica particles A and 0.1 to 1.5 mass % of silica particles B to demonstrate the advantageous effects of the present invention.

<Other External Additives>

Besides the silica particles A and the silica particles B, the toner according to the present invention may further contain external additives, i.e., the following titanium oxide nanoparticles and known other external additives.

(Titanium Oxide Nanoparticles)

The toner according to the present invention preferably further contains an external additive of titanium oxide nanoparticles having an average aspect ratio in the range of 2 to 15. Titanium oxide nanoparticles having an average aspect ratio within this range have a larger contact area with the particulate toner matrix than that of titanium oxide nanoparticles having a smaller average aspect ratio, and barely migrate on the surface of the particulate toner matrix. Accordingly, the toner particles can keep a uniform coating of titanium oxide nanoparticles under strong stress caused by continuous stirring in a developer container. The advantageous effects of the present invention, such as control of the charging characteristics of the toner, can be effectively demonstrated through addition of the titanium oxide nanoparticles. Titanium oxide nanoparticles having an average aspect ratio of less than 2 have insufficient contact areas with the particulate toner matrix. Titanium oxide nanoparticles having an average aspect ratio of more than 15 result in reduced contact areas with the spherical surface of the toner matrix, and readily drop off from the particulate toner matrix. The titanium oxide nanoparticles have an average aspect ratio of preferably 2.5 to 13.5, more preferably 3 to 10 to further ensure the contact areas of the titanium oxide nanoparticles with the particulate toner matrix.

The toner according to the present invention contains 0.05 to 1.0 mass % of external additive titanium oxide nanoparticles having an average aspect ratio in the range of 2 to 15 to demonstrate the advantageous effects of the present invention.

In this specification, the average aspect ratio is determined as follows: The major diameters (maximum diameters if the nanoparticles are almost spherical) and minor diameters (minimum diameters if the nanoparticles are almost spherical) of titanium oxide nanoparticles in an electron microscopic photograph are measured with a scanning electron microscope (SEM) "JSM-7401F" (made by JEOL, Ltd.). The number average major diameter and the number average minor diameter are determined from the major diameters and the minor diameters of 20 nanoparticles. Using the number average major diameter and the number average minor diameter, the average aspect ratio can be calculated from the following expression:

Average aspect ratio=(number average major diameter)/(number average minor diameter)

The titanium oxide nanoparticles used can be prepared by a known process. Examples thereof include sulfuric acid processes, hydrothermal preparation in high-temperature high-pressure water solvent, combustive decomposition of titanium tetrachloride, chemical treatment of hydrous titanium oxide nanoparticles, heating processes, wet processes, and sol-gel processes.

The titanium oxide nanoparticles preferably have a rutile crystal structure. Rutile titanium oxide has a higher calcination temperature and a smaller amount of surface hydroxy groups than those of anatase titanium oxide. Such features of rutile titanium oxide can protect the toner from influences of humidity, ensuring sufficient resistance independent of its surrounding environment. Accordingly, external addition of rutile titanium oxide can impart higher environmental stability of the charge amount to the toner.

In a wet preparative process of rutile titanium oxide nanoparticles, titanium alkoxide is added dropwise to hydrous methanol being stirred. In this step, the dropping time and the solvent composition are adjusted, and the resulting particles are kept in a well dispersed state with stirring. The growth of the titanium oxide nanoparticles can be controlled by the reaction time. A longer reaction time promotes further growth of the particles grow in one axial direction, and the average aspect ratio can be controlled by the reaction time. The titanium oxide nanoparticles are centrifugally recovered, and are dried under reduced pressure to yield amorphous titanium oxide. The amorphous titanium oxide can be annealed in the air at about 600 to 900° C. to yield rutile titanium oxide nanoparticles.

(Known Other External Additives)

The toner according to the present invention may further contain other known external additives. The known external additives can be inorganic nanoparticles, organic nanoparticles, and a lubricant described later, for example.

Examples of the inorganic include inorganic oxide nanoparticles, such as aluminum oxide and titanium oxide nanoparticles; organic metal stearate nanoparticles, such as aluminum stearate and zinc stearate nanoparticles; and inorganic titanate nanoparticles, such as strontium titanate and zinc titanate nanoparticles. These inorganic nanoparticles may be subjected to a gloss and hydrophobic treatment with a silane coupling agent, a titanium coupling agent, higher fatty acid, or silicone oil to improve the heat-resistant storage characteristics and the environmental stability of the toner. The inorganic nanoparticles may be titanium oxide nanoparticles as described above. This description indicates that known titanium oxide nanoparticles having an average aspect ratio of less than 2 may be added besides the "titanium oxide nanoparticles having an average aspect ratio in the range of 2 to 15".

The organic nanoparticles can be spherical organic nanoparticles having a number average primary-particle diameter of about 10 to 2000 nm, for example. Specifically, organic nanoparticles composed of a homopolymer of styrene or methyl methacrylate or a copolymer thereof can be used.

The lubricant is used to further improve the cleaning characteristics and transfer characteristics of the toner. The lubricant can be a metal salt of higher fatty acid, for example. Specific examples of the metal salts of higher fatty acids include salts of stearic acid with zinc, aluminum, copper, magnesium, and calcium; salts of oleic acid with zinc, manganese, iron, copper, and magnesium; salts of palmitic acid with zinc, copper, magnesium, and calcium; salts of linoleic acid with zinc and calcium; and salts of ricinoleic acid with zinc and calcium.

<Binder Resin>

The particulate toner matrix according to the present invention preferably contains a binder resin including an amorphous resin and a crystalline resin. The binder resin may contain only an amorphous resin.

<Amorphous Resin>

An amorphous resin indicates a resin having a relatively high glass transition temperature (Tg) but not a melting point in differential scanning calorimetry (DSC). The amorphous resin can have any glass transition temperature (Tg). The preferred glass transition temperature is in the range of 25 to 60° C. to ensure fixing characteristics, such as low-temperature fixing characteristics, and heat resistance, such as heat-resistant storage characteristics and blocking resistance. In this specification, the glass transition temperature (Tg) of the resin measured with the procedure in Examples is used.

Any amorphous resin having these characteristics can be used. Conventional amorphous resins known in this technical field can be used. Specific examples thereof include vinyl resins, urethane resins, and urea resins. Among these resins, preferred are vinyl resins because the thermoplasticity can be readily controlled.

Any vinyl resin prepared through polymerization of a vinyl compound can be used. Examples thereof include (meth)acrylate ester resins, styrene-(meth)acrylate ester resins, and ethylene-vinyl acetate resins. These vinyl resins can be used alone or in combination.

Among these vinyl resins, preferred are styrene-(meth) acrylate ester resins in consideration of the plasticity of the toner during thermal fixing. The amorphous resin or the styrene-(meth)acrylate ester resin (hereinafter, also referred to as "styrene-(meth)acrylic resin") will now be described.

The styrene-(meth)acrylic resin is prepared through addition polymerization of at least a styrene monomer and a (meth)acrylate ester monomer. In this specification, the styrene monomer indicates styrene represented by the formula $CH_2{=}CH{-}C_6H_5$, and also includes monomers having a known side chain or functional group in a styrene structure. In this specification, the (meth)acrylate ester monomer indicates an acrylate or methacrylate ester compound represented by $CH_2{=}CHCOOR$ (where R is an alkyl group), and also includes ester compounds having a known side chain or functional group in the structure, such as acrylate ester derivatives and methacrylate ester derivatives. In this specification, the term "(meth)acrylate ester monomer" collectively indicates "acrylate ester monomer" and "methacrylate ester monomer".

Examples of the styrene monomer and the (meth)acrylate ester monomer usable in formation of the styrene-(meth) acrylic resin are listed below.

Specific examples of the styrene monomer include styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, and p-n-dodecylstyrene. These styrene monomers can be used alone or in combination.

Specific examples of the (meth)acrylate ester monomer include acrylate ester monomers, such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, and phenyl acrylate; and methacrylate ester monomers, such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate, and dimethylaminoethyl methacrylate. These (meth)acrylate ester monomers can be used alone or in combination.

The content of the structural unit derived from the styrene monomer in the styrene-(meth)acrylic resin is preferably in the range of 40 to 90 mass % relative to the total amount of the resin. The content of the structural unit derived from the (meth)acrylate ester monomer in the resin is preferably 10 to 60 mass % relative to the total amount of the resin.

Besides the styrene monomer and the (meth)acrylate ester monomer, the styrene-(meth)acrylic resin may further contain the following monomer compound. Examples of the monomer compound include compounds having a carboxy group, such as acrylic acid, methacrylic acid, maleic acid, itaconic acid, cinnamic acid, fumaric acid, monoalkyl maleate ester, and monoalkyl itaconate ester; and compounds having a hydroxy group, such as 2-hydroxyethyl (meth)acrylate, 2-hydroxypropyl (meth)acrylate, 3-hydroxypropyl (meth)acrylate, 2-hydroxybutyl (meth)acrylate, 3-hydroxybutyl (meth)acrylate, and 4-hydroxybutyl (meth) acrylate. These monomer compounds can be used alone or in combination.

The content of the structural unit derived from the monomer compound in the styrene-(meth)acrylic resin is preferably in the range of 0.5 to 20 mass % relative to the total amount of the resin.

The styrene-(meth)acrylic resin preferably has a weight average molecular weight (Mw) of 10000 to 100000. The styrene-(meth)acrylic resin can be prepared by any process. Examples thereof include known polymerization processes, such as bulk polymerization, solution polymerization, emulsion polymerization, miniemulsion polymerization, and dispersion polymerization, in the presence of any polymerization initiator, such as peroxide, persulfides, persulfates, or azo compounds usually used in polymerization of the monomers. A chain transfer agent usually used can also be used to control the molecular weight of the resin. Any chain transfer agent can be used. Examples thereof include alkylmercaptans, such as n-octylmercaptan, and mercapto-fatty acid esters.

The binder resin can contain the amorphous resin in any content. The content of the amorphous resin is preferably more than 50 mass %, more preferably 70 mass % or more, particularly more preferably 90 mass % or more relative to the total amount of the binder resin. The content of the amorphous resin has no upper limit. In other words, the content is 100 mass % or less.

<Crystalline Resin>

The particulate toner matrix according to the present invention preferably contains a binder resin containing a crystalline resin. The crystalline resin used in combination with the amorphous resin results in compatibilization of the crystalline resin and the amorphous resin during thermal fixing of the toner. Such compatibilization results in the low-temperature fixing of the toner, and thus further energy saving.

In this specification, the crystalline resin indicates a resin having a distinct endothermic peak, rather than a stepwise endothermic change, in differential scanning calorimetry (DSC). The distinct endothermic peak has a half width within 15° C. or less at a heating rate of 10° C./min in the DSC.

Any crystalline resin having these characteristics can be used. Common crystalline resins known in this technical field can be used. Specific examples of the crystalline resins include polyesters, polyurethanes, polyureas, polyamides, and polyethers. These crystalline resins can be used alone or in combination.

Among these crystalline resins, preferred are crystalline polyester resins. In this specification, the "crystalline polyester resin" indicates a resin satisfying the endothermic characteristics described above among known polyester resins prepared by a polycondensation reaction of a di- or higher-valent carboxylic acid (polyvalent carboxylic acid) or a derivative thereof with a di- or higher-hydric alcohol (polyhydric alcohol) or a derivative thereof.

The crystalline polyester resin can have any melting point. The melting point is preferably in the range of 55 to 90° C., more preferably 60 to 85° C. A crystalline polyester resin having a melting point within this range results in a toner having sufficient low-temperature fixing characteristics. The melting point of the crystalline polyester resin can be controlled by the resin composition. In this specification, the melting point of the resin measured according to the procedure in Examples is used.

The polyvalent carboxylic acid and the polyhydric alcohol forming the crystalline polyester resin have a valency of preferably 2 to 3, more preferably 2. A divalent polyvalent carboxylic acid and a dihydric polyhydric alcohol (i.e., the dicarboxylic acid component and the diol component) will now be described.

The dicarboxylic acid component is preferably an aliphatic dicarboxylic acid in combination with an aromatic dicarboxylic acid, when necessary. A linear aliphatic dicarboxylic acid is preferred. An advantage of the linear aliphatic dicarboxylic acid is the improved crystallinity of the crystalline polyester resin. These dicarboxylic acid components may be used alone or in combination.

Examples of the aliphatic dicarboxylic acid include oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid (dodecanedioic acid), 1,11-undecanedicarboxylic acid, 1,12-dodecanedicarboxylic acid (tetradecanedioic acid), 1,13-tridecanedicarboxylic acid, 1,14-tetradecanedicarboxylic acid, 1,16-hexadecanedicarboxylic acid, and 1,18-octadecanedicarboxylic acid.

Among these aliphatic dicarboxylic acids, preferred are aliphatic dicarboxylic acids having 6 to 14 carbon atoms, and more preferred are aliphatic dicarboxylic acids having 8 to 14 carbon atoms.

Examples of the aromatic dicarboxylic acid usable in combination with the aliphatic dicarboxylic acid include phthalic acid, terephthalic acid, isophthalic acid, orthophthalic acid, t-butylisophthalic acid, 2,6-naphthalenedicarboxylic acid, and 4,4'-biphenyldicarboxylic acid. Among these aromatic dicarboxylic acids, preferred are terephthalic acid, isophthalic acid, and t-butylisophthalic acid in view of availability and ease of emulsification.

These dicarboxylic acids may be replaced with polyvalent carboxylic acids having three or more valencies, such as trimellitic acid and pyromellitic acid, anhydrides of these corboxlic acids or alkyl esters having 1 to 3 carbon atoms of the dicarboxylic acids described above.

In the dicarboxylic acid component forming the crystalline polyester resin, the content of the aliphatic dicarboxylic acid is desirably at least 50 mol %, preferably at least 70 mol %, more preferably at least 80 mol %, most preferably 100 mol %. A dicarboxylic acid component containing at least 50 mol % of aliphatic dicarboxylic acid can ensure the sufficiently high crystallinity of the polyester resin.

The diol component is preferably an aliphatic diol in combination with a diol other than an aliphatic diol, when necessary. A linear aliphatic diol is preferred. An advantage of the linear aliphatic diol is the improved crystallinity of the crystalline polyester resin. The diol components may be used alone or in combination.

Examples of the aliphatic diol include ethylene glycol, 1,2-propanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, 1,20-eicosanediol, and neopentyl glycol.

Among these aliphatic diols, the diol component is preferably aliphatic diols having 2 to 12 carbon atoms, more preferably 3 to 10 carbon atoms.

The diols are usable in combination with the aliphatic diol having double bonds or sulfonate groups. Specific examples of the diols having double bonds include 1,4-butenediol, 2-butene-1,4-diol, 3-hexene-1,6-diol, and 4-octene-1,8-diol. The diol usable in combination with the aliphatic diol may be replaced with three- or higher-hydric alcohols. Examples of the three- or higher-hydric alcohols include glycerol, pentaerythritol, trimethylolpropane, and sorbitol.

In the diol component forming the crystalline polyester resin, the content of the aliphatic diol is preferably at least 50 mol %, more preferably at least 70 mol %, still more preferably at least 80 mol %, particularly preferably 100 mol %. A diol component containing 50 mol % or more of aliphatic diol can ensure the crystallinity of the crystalline polyester resin, resulting in a toner having excellent low-temperature fixing characteristics.

The crystalline polyester resin has a weight average molecular weight (Mw) of preferably 3000 to 100000, more preferably 4000 to 50000, most preferably 5000 to 20000 to ensure the compatibility between sufficient low-temperature fixing characteristics and high long-term heat-resistant storage stability. The ratio of the diol component to the dicarboxylic acid component, i.e., the ratio [OH]/[COOH] of an equivalent of hydroxy groups [OH] in the diol component to an equivalent of carboxy groups [COOH] in the dicarboxylic acid component is preferably within the range of 1.5/1 to 1/1.5, more preferably 1.2/1 to 1/1.2.

The crystalline polyester resin can be prepared by any polycondensation (esterification) of dicarboxylic acid and dihydric alcohol in the presence of a known esterification catalyst.

Examples of the catalyst usable in preparation of the crystalline polyester resin include compounds of alkali metals, such as sodium and lithium; compounds containing Group II elements, such as magnesium and calcium; compounds of metals, such as aluminum, zinc, manganese, antimony, titanium, tin, zirconium, and germanium; phosphite compounds; phosphate compounds; and amine compounds. Specific examples of tin compounds include dibutyltin oxide, and organic tin salts, such as tin octylate and tin dioctylate. Examples of titanium compounds include titanium alkoxides, such as tetra-n-butyl titanate, tetraisopropyl titanate, tetramethyl titanate, and tetrastearyl titanate; titanium acylates, such as polyhydroxytitanium stearate; and titanium chelates, such as titanium tetraacetylacetonate, titanium lactate, and titanium triethanolaminate. Examples of germanium compounds include germanium dioxide. Examples of aluminum compounds include aluminum oxides, such as aluminum polyhydroxide; aluminum alkoxides; and tributyl aluminate. These aluminum compounds may be used alone or in combination.

The polymerization may be carried out at any temperature, preferably in the range of 150 to 250° C. Any polymerization time can be used. The preferred polymerization time is in the range of 0.5 to 15 hours. The pressure of the reaction system may be reduced during polymerization as needed.

The binder resin may contain any amount of crystalline resin (preferably, crystalline polyester resin). The content is preferably less than 50 mass %, more preferably 30 mass % or less, most preferably 10 mass % or less relative to the total amount of the binder resin. If the crystalline resin is a crystalline polyester resin, a content of less than 50 mass % can reduce the environmental dependency of the electrical charge attributed to the moisture absorption of the crystalline polyester resin. Any lower limit of the content can be used. In the binder resin containing a crystalline resin (preferably, crystalline polyester resin), the preferred content is 5 mass % or more. If the content of the crystalline resin is 5 mass % or more relative to the total amount of the binder resin, the resulting toner has high low-temperature fixing characteristics.

<Colorant>

Any colorant, such as carbon black, magnetic substances, dyes, and pigments, can be used.

Examples of usable carbon black include channel black, furnace black, acetylene black, thermal black, and lamp black.

Examples of the magnetic substances include ferromagnetic metals, such as iron, nickel, and cobalt; alloys containing these metals; and compounds of ferromagnetic metals, such as ferrite and magnetite.

Examples of the dyes include C.I. Solvent Reds 1, 49, 52, 58, 63, 111, and 122; C.I. Solvent Yellows 19, 44, 77, 79, 81, 82, 93, 98, 103, 104, 112, and 162; C.I. Solvent Blues 25, 36, 60, 70, 93, and 95; and mixtures thereof.

Examples of the pigments include C.I. Pigment Reds 5, 48:1, 48:3, 53:1, 57:1, 81:4, 122, 139, 144, 149, 166, 177, 178, and 222; C.I. Pigment Oranges 31 and 43; C.I. Pigment Yellows 14, 17, 74, 93, 94, 138, 155, 180, and 185; C.I. Pigment Green 7; C.I. Pigment Blues 15:3, 15:4, and 60; and mixtures thereof.

<Mold Release Agent (Wax)>

The mold release agent may be a variety of known waxes.

Examples of the waxes include polyolefin waxes, such as polyethylene wax and polypropylene wax; branched hydrocarbon waxes, such as microcrystalline wax; long-chain hydrocarbon waxes, such as paraffin wax and SASOL wax; dialkyl ketone waxes, such as distearyl ketone; ester waxes, such as carnauba wax, montan wax, behenyl behenate, trimethylolpropane tribehenate, pentaerythritol tetrabehenate, pentaerythritol diacetate dibehenate, glycerol tribehenate, 1,18-octadecanediol distearate, tristearyl trimellitate, and distearyl maleate; and amide waxes, such as ethylenediaminebehenylamide and trimellitic tristearylamide.

The content of the mold release agent is preferably in the range of 0.1 to 30 parts by mass, more preferably 1 to 10 parts by mass relative to 100 parts by mass of binder resin. These mold release agents can be used alone or in combination. The preferred melting point of the mold release agent is in the range of 50 to 95° C. in view of the low-temperature fixing characteristics and releasing characteristics of the electrophotographic toner.

<Charge Controlling Agent>

The particulate toner matrix according to the present invention can contain a charge controlling agent when necessary. A variety of known charge control agents that can be dispersed in an aqueous medium can be used.

Examples thereof include nigrosine dyes, metal salts of naphthenic acid or higher fatty acids, alkoxylated amines, quaternary ammonium salts, azo metal complexes, and salicylic acid metal salts or metal complexes thereof.

The content of the charge controlling agent is in the range of preferably 0.1 to 10 parts by mass, more preferably 0.5 to 5 parts by mass relative to 100 parts by mass of binder resin.

<Diameter of Particulate Toner Matrix>

The particulate toner matrix has a number median diameter ($d_{50}$) in the range of preferably 3 to 10 μm, more preferably 4 to 7 μm.

A particulate toner matrix having a diameter within this range results in high reproducibility of very fine dot images at a dot density of 1200 dpi.

The average diameter of toner particles can be controlled by the concentration of the coagulating agent used in preparation of the toner, the amount of an organic solvent to be added, the fusing time, and the composition of the binder resin.

The number median diameter of the particulate toner matrix is the median diameter in number-based diameter distribution, and can be measured and calculated with a particle size analyzer Multisizer 3 (made by Beckman Coulter, Inc.) connected to a computer system for data processing.

In the procedure for measurement, for example, toner particles (0.02 g) are mixed with 20 mL of surfactant solution (surfactant solution for dispersing toner particles, for example, which is prepared with a neutral detergent containing a surfactant component, and is diluted ten fold with pure water), and are ultrasonically dispersed for one minute to prepare a particulate toner matrix dispersion. The particulate toner matrix dispersion is injected with a pipette into ISOTON II (made by Beckman Coulter, Inc.) in a beaker on a sample stand until the concentration reaches 5 to 10%. In this specification, the concentration in this range can provide reproducibility in the measurement. The counts of particles are set at 25000, and the aperture diameter of Multisizer 3 (made by Beckman Coulter, Inc.) is set at 100 μm. The range of the measurement from 1 to 30 μm is divided into 256 subranges to calculate the frequencies in the subranges. The 50% particle diameter from the maximum-number fraction in the cumulative distribution curve is defined as a number median diameter.

<Average Circularity of Particulate Toner Matrix>

The particulate toner matrix has an average circularity in the range of preferably 0.930 to 1.000, more preferably 0.950 to 0.995 to enhance the stability of the charging characteristics and the low-temperature fixing characteristics of the toner.

An average circularity within this range reduces the crush of particulate toner matrices, and thus can reduce the contamination of a frictional charging member, resulting in stabilized charging characteristics of the toner and improved quality of images.

The average circularity of the particulate toner matrix is measured with a flow-type particle image analyzer "FPIA-3000" (made by Sysmex Corporation). Specifically, the particulate toner matrix is wetted in an aqueous surfactant solution, and is ultrasonically dispersed for one minute. After the dispersion, the average circularity is measured with the analyzer "FPIA-3000" in a high power field (HPF) mode at an appropriate density (the number of particles to be detected at an HPF: 3000 to 10000 particles). This range can provide reproducibility in the measurement. The circularity is calculated from the following expression:

Circularity of particulate toner matrix=(perimeter of a circle having a projected area identical to that of the projected image of a particle)/(perimeter of the projected image of the particle)

In this specification, the average circularity of the particulate toner matrix indicates the arithmetic average obtained by dividing the sum of circularities of particles by the number of particles.

<Core-Shell Structure>

The toner particles can be used as they are. Alternatively, the toner particles may have a multi-layered structure, such as a core-shell structure composed of toner particles as core particles and a shell layer coating the surfaces of the core particles. The surfaces of the core particles may be partially coated with the shell layer. In other words, the core particles may be partially exposed. The cross-section of the core-shell structure can be observed with any known analytical instrument, for example, a transmission electron microscope (TEM) or a scanning probe microscope (SPM).

In the core-shell structure, the core particles and the shell layer may have different characteristics, such as glass transition temperature, melting point, and hardness, to design desired toner particles. For example, a resin having a relatively high glass transition temperature (Tg) can be aggregated, and be fused onto the surfaces of core particles containing a binder resin, a colorant, and a mold release agent having a relatively low glass transition temperature (Tg) to form a shell layer. The shell layer preferably contains an amorphous resin.

<Two-Component Developer>

Mixing the toner according to the present invention with the following carrier particles results in a two-component developer. Any mixer can be used. Examples thereof include Nauta Mixers, double cone mixers, and V-type mixers.

The two-component developer can contain the toner in any content (concentration). The preferred content is 4.0 to 8.0 mass %.

<Carrier Particles>

Carrier particles are composed of a magnetic substance. Known carrier particles can be used. Examples of the carrier particles include resin-coated carrier particles composed of core particles of a magnetic substance coated with a layer of a coating material, and resin-dispersed carrier particles containing magnetic substance nanoparticles dispersed in a resin. Preferred carrier particles are resin-coated carrier particles to reduce the adhesion of the carrier particles onto a photoreceptor. The resin-coated carrier particles will now be described.

The core particles (carrier cores) for the resin-coated carrier particles are composed of a magnetic substance or a substance strongly magnetizable in a magnetic field, for example. Examples of such a magnetic substance include ferromagnetic metals, such as iron, nickel, and cobalt; alloys and compounds containing these metals; and alloys demonstrating ferromagnetism after subjected to a heat treatment. These magnetic substances can be used alone or in combination.

Examples of the ferromagnetic metals and the alloys and compounds containing these metals include iron, ferrites represented by Formula (a), and magnetites represented by Formula (b). In Formulae (a) and (b), M represents one or more metals selected from the group consisting of Mn, Fe, Ni, Co, Cu, Mg, Zn, Cd, and Li.

$$MO.Fe_2O_3 \qquad \text{Formula (a)}$$

$$MFe_2O_4 \qquad \text{Formula (b)}$$

Examples of the alloys demonstrating ferromagnetism after subjected to a heat treatment include Heusler alloys, such as manganese-copper-aluminum and manganese-copper-tin; and chromium dioxide.

Usually, the resin-coated carrier particles have a true density smaller than that of the metal forming the core particles. Among these core particles, preferred are a variety of ferrites to further reduce the impact during stirring of the toner in the developer container.

The surfaces of the core particles can be coated with a coating material (carrier-coating resin) to prepare resin-coated carrier particles. The coating material used in this step may be any known resin used in coating of the core particles. Examples of such resins include polyolefin resins, such as polyethylene and polypropylene; polystyrene resins; (meth)acrylic resins, such as polymethyl methacrylate; polyvinyl resins and polyvinylidene resins, such as polyacrylonitrile, poly(vinyl acetate), poly(vinyl alcohol), poly(vinyl butyral), and poly(vinyl chloride); copolymer resins, such as vinyl chloride-vinyl acetate copolymers and styrene-acrylate copolymers; silicone resins having organosiloxane bonds or modified resins thereof (such as resins modified with alkyd resin, polyester resin, epoxy resin, or polyurethane); fluorinated resins, such as poly(vinylfluoride); polyamide resins; polyester resins; polyurethane resins; polycarbonate resins; amino resins, such as urea-formaldehyde resins; and epoxy resins.

The preferred coating material is a resin having a cycloalkyl group to reduce the moisture adsorption of the carrier particles and enhance the adhesion between the coating material and the core particles. Examples of the cycloalkyl group include cyclopropyl, cyclobutyl, cyclopentyl, cyclohexyl, cycloheptyl, cyclooctyl, cyclononyl, and cyclodecyl groups. Among these cycloalkyl groups, preferred is a cyclopentyl or cyclohexyl group, and more preferred is a cyclohexyl group in view of the adhesion between the coating material and the core particles (preferably ferrite particles).

The carrier-coated resin as the coating material can have any weight average molecular weight (Mw). The weight average molecular weight is in the range of preferably 10000 to 800000, more preferably 100000 to 750000. The weight average molecular weight (Mw) can be determined with a gel permeation chromatograph (GPC) according to the procedure to measure the molecular weight of the crystalline resin in Examples. The content of the structural unit having the cycloalkyl group in the resin is 10 to 90 mass %, for example. The content of the structural unit having the cycloalkyl group in the resin can be determined by pyrolysis-gas chromatography/mass spectrometry (Py-GC/MS) or $^{1}$H-NMR, for example.

The coating material and the core particles can adhere to each other under mechanical impact or heat to yield carrier particles.

The carrier particles have a volume median diameter of preferably 15 to 100 μm, more preferably 25 to 80 μm.

The median diameter of the carrier particles is determined by a wet process with a laser diffraction particle size analyzer "HELOS KA" (made by Japan Laser Corporation). Specifically, an optical system having a focal position of 200 mm is selected, and the run time is set at five seconds. The magnetic particles to be measured is added to an aqueous 0.2% sodium dodecylsulfate solution, and are dispersed in an ultrasonic washer "US-1" (made by AS ONE Corporation) for three minutes to prepare a dispersion sample. Several drops of the dispersion sample are fed into the laser diffraction particle size analyzer. When the concentration of the dispersion sample reaches the measureable range, the measurement is started. From the resulting particle diameter distribution, a cumulative distribution curve is generated from the smallest diameter in the measured diameter range (channel), and the cumulative 50% particle diameter is defined as the volume-based median diameter.

[Preparation of Electrostatically Charged Image Developing Toner]

The toner according to the present invention can be prepared by any known process. Examples of the process include kneading pulverization, suspension polymerization, emulsion coagulation, dissolution suspension, polyester extension, and dispersion polymerization. Among these processes, preferred is emulsion coagulation in view of the uniformity of the particle diameter and control of the shape of the toner.

In emulsion coagulation, toner particles are prepared as follows: A dispersion of particles of a binder resin dispersed in a surfactant containing a dispersion stabilizer (hereinafter, also referred to as "binder resin particles") is mixed with a dispersion of particles of a colorant (hereinafter, also referred to as "colorant particles") when necessary, and these particles are aggregated until the toner particles grow to a desired diameter. The binder resin particles are further fused to control the shapes of the toner particles. In this specification, the binder resin particles may optionally contain a mold release agent and a charge controlling agent.

In a preferred embodiment in preparation of the toner according to the present invention, toner particles having a core-shell structure are prepared by an emulsion coagulation process including:

(1) a step of preparing a dispersion of colorant particles dispersed in an aqueous medium, (2) a step of dispersing binder resin particles containing internal additives when necessary in aqueous media to prepare dispersions of resin particles (dispersion of resin particles for a core and dispersion of resin particles for a shell layer), (3) a step (aggregation and fusion step) of mixing the dispersion of colorant particles with the dispersion of resin particles for a core to yield a resin particle dispersion for aggregation, and aggregating and fusing colorant particles and binder resin particles in the presence of a coagulating agent to form aggregated particles as core particles, (4) a step (aggregation and fusion step) of adding the dispersion of resin particles for a shell layer to the dispersion of resin particles for a core, and aggregating and fusing the particles for a shell layer onto the surfaces of the core particles to form particulate toner matrices having a core-shell structure, (5) a step (washing step) of filtering the particulate toner matrices from the dispersion of a particulate toner matrix (particulate toner matrix dispersion) to remove the surfactant.

(6) a step (drying step) of drying the particulate toner matrices, and (7) a step (external addition step) of adding an external additive to the particulate toner matrices.

The toner particles having a core-shell structure can be prepared as follows: Binder resin particles for core particles and colorant particles are aggregated and fused into core particles. Binder resin particles for a shell layer are added to the dispersion of core particles, and binder resin particles for a shell layer are aggregated and fused onto the surfaces of the core particles to form a shell layer on the surfaces of the core particles.

The process of preparing a particulate toner matrix having a core-shell structure is described. The shell layer however is not essential.

The core particles may have a multi-layered structure of two or more layers formed with binder resins having different compositions. For example, binder resin nanoparticles having a three-layered structure can be prepared through three polymerization stages to synthesize a binder resin, i.e., first polymerization stage (formation of an internal layer), second polymerization stage (formation of an intermediate layer), and third polymerization stage (formation of an outer layer). In this specification, in each of the first to third polymerization stages, different polymerizable monomer compositions can be used to prepare binder resin nanoparticles having a three-layered structure having different compositions. For example, the synthetic reaction of the binder resin containing an appropriate internal additive, such as a mold release agent, is performed in one of the first to third polymerization stage. Binder resin nanoparticles having a three-layered structure and containing an appropriate internal additive can thereby be prepared.

<External Addition>

An external additive can be mixed with the particulate toner using a mechanical mixer. The mechanical mixer used may be a Henschel mixer, a Nauta Mixer, or a turbular mixer. Among these mixers, a Henschel mixer, which can impart shear force to the particles, may be used to mix the materials for a longer time or with a stirring blade at a higher circumferential speed of rotation. If several external additives are used, all of the external additives may be mixed with the toner particles in one batch, or several aliquots of the external additives may be mixed with the toner particles.

In the mixing of the external additive, the degree of crush or adhesive strength of the external additive can be controlled with the mechanical mixer through control of the mixing strength or circumferential speed of the stirring blade, the mixing time, or the mixing temperature. In the present invention, preferably, the silica particles B are crushed, and are simultaneously mixed with the silica particles A.

[Formation of Electrophotographic Image]

One example of a suitable image forming method using the electrostatically charged image developing toner according to the present invention will be described using an image forming apparatus illustrated in FIG. 1.

The electrophotographic image forming process according to the present invention using the electrostatically charged image developing toner according to the present invention includes a discharging step, an exposing step, a developing step, and a transfer step. The transfer step includes a primary transfer substep of transferring a toner image from an electrostatic latent image carrier (photoreceptor drum 413) onto an intermediate transfer member (intermediate transfer belt 421), and a secondary transfer substep of transferring the toner image on the intermediate transfer member onto a transfer material (sheet S).

An image forming apparatus 100 illustrated in FIG. 1 includes an image reader 110, an image processor 30, an image forming unit 40, a sheet conveyer 50, and a fixing unit 60.

The image forming unit 40 includes image forming subunits 41Y, 41M, 41C, and 41K forming images of yellow (Y), magenta (M), cyan (C), and black (K) toners. These image forming subunits 41Y, 41M, 41C, and 41K have the same configuration other than the color of the toner, and the symbols representing the colors are omitted in some cases below. The image forming unit 40 further includes an intermediate transfer subunit 42 and the secondary transfer subunit 43. These subunits make up a transfer unit.

The image forming subunit 41 includes an exposing unit 411, a developing unit 412, a photoreceptor drum 413, a charging unit 414, and a drum cleaning unit 415.

The photoreceptor drum 413 is a negative-charging organic photoreceptor, for example. The surface of the photoreceptor drum 413 has photoconductivity. The photoreceptor drum 413 corresponds to a photoreceptor. The charging unit 414 is a corona charger, for example. The charging unit 414 may be of a contact type that brings the photoreceptor drum 413 into contact with a contact charging member, such as a charging roller, a charging brush, or a charging blade, and charges the photoreceptor drum 413. The exposing unit 411, for example, includes a semiconductor laser as a light source, and a light polarizer (polygon motor) irradiating the photoreceptor drum 413 with laser light for forming the image.

The developing unit 412 is of a two-component developing type. The developing unit 412 includes a developer container accommodating a two-component developer, a developing roller (magnetic roller) rotatably disposed in an opening of the developer container, a wall partitioning the inside of the developer container into two sections in commutation with each other, a feed roller feeding the two-component developer at the opening of the developer container to the developing roller, and an agitation roller agitating the two-component developer in the developer container, for example. The developer container accommodates the two-component developer or toner described above.

The intermediate transfer subunit 42 includes a primary transfer roller 422 urging the intermediate transfer belt 421 to the photoreceptor drum 413, a plurality of support rollers 423 including a backup roller 423A, and a belt cleaning unit 426. The intermediate transfer belt 421 extends under tension around the support rollers 423 in the form of a loop. At least one of the support rollers 423 rotates to travel the intermediate transfer belt 421 in the direction of the arrow A at a predetermined rate.

The secondary transfer subunit 43 includes an endless secondary transfer belt 432, and a plurality of support rollers 431 including a secondary transfer roller 431A. The secondary transfer belt 432 extends under tension around the secondary transfer roller 431A and the support rollers 431 in the form of a loop.

The fixing unit 60 includes a fixing roller 62, an endless heating belt 63 disposed over the outer peripheral surface of the fixing roller 62 to melt a toner forming a toner image on a sheet S by heat, and an urging roller 64 pressing the sheet S against the fixing roller 62 and the heating belt 63, for example.

The image forming apparatus 100 further includes an image reader 110, the image processor 30, and the sheet conveyer 50. The image reader 110 includes a sheet feeding unit 111 and a scanner 112. The sheet conveyer 50 includes a sheet feeder 51, a sheet discharger 52, and a sheet feeding path 53. Sheets S (standard sheets, special sheets) classified according to the basis weight or the size are stacked in three sheet feeding trays 51*a* to 51*c* forming the sheet feeder 51 according to the predetermined sheet type. The sheet feeding path 53 includes a plurality of conveying rollers, such as a pair of registration rollers 53*a*.

An exemplary image forming process using the image forming apparatus 100 will now be described.

The scanner 112 reads a document Don a contact glass by optical scanning. A CCD sensor 112*a* reads the reflected light from the document D into input image data. The image processor 30 processes the input image data in a predetermined manner, and transmits the processed data to the exposing unit 411.

The photoreceptor drum 413 rotates at a predetermined circumferential speed. The charging unit 414 uniformly accumulates negative charges on the surface of the photoreceptor drum 413. In the exposing unit 411, a polygon mirror of a polygon motor rotates at high rate, and laser light corresponding to the input image data of each color component is scanned along the axial direction of the photoreceptor drum 413 to irradiate the outer peripheral surface of the photoreceptor drum 413 in the axis direction thereof with the laser light. An electrostatic latent image is thereby formed on the surface of the photoreceptor drum 413.

In the developing unit 412, the toner particles of the two-component developer in the developer container are charged by agitation and transfer. The two-component developer is fed onto the developing roller to form a magnetic brush on the surface of the developing roller. The charged toner particles are electrostatically applied from the magnetic brush onto part of the electrostatic latent image on the photoreceptor drum 413. The electrostatic latent image on the surface of the photoreceptor drum 413 is thereby visualized in the form of a toner image corresponding to the electrostatic latent image on the surface of the photoreceptor drum 413.

The intermediate transfer subunit 42 transfers the toner image on the surface of the photoreceptor drum 413 onto the intermediate transfer belt 421. After the transfer, the residual transfer toner on the surface of the photoreceptor drum 413 is removed by the drum cleaning unit 415 including a drum cleaning blade which slides on the surface of the photoreceptor drum 413.

The primary transfer rollers 422 urges the intermediate transfer belt 421 against the photoreceptor drums 413 to form primary transfer nips between the photoreceptor drums 413 and the intermediate transfer belt 421. The toner images of the four colors are sequentially layered on the intermediate transfer belt 421 at the primary transfer nips.

The secondary transfer roller 431A is urged against the backup roller 423A with the intermediate transfer belt 421 and the secondary transfer belt 432 interposed. A secondary transfer nip is thereby formed between the intermediate transfer belt 421 and the secondary transfer belt 432. A sheet S passes through the secondary transfer nip. The sheet S is conveyed on the sheet conveyer 50 to the secondary transfer nip. The inclination of the sheet S and the timing of the transfer are adjusted by a registration roller unit including a pair of registration rollers 53*a*.

After the sheet S is conveyed to the secondary transfer nip, transfer bias is applied to the secondary transfer roller 431A. After the application of the transfer bias, the toner image carried on the intermediate transfer belt 421 is transferred onto the sheet S. The sheet S having the transferred toner image is conveyed to the fixing unit 60 by the secondary transfer belt 432.

In the fixing unit 60, the heating belt 63 and the pressurizing roller 64 form a fixing nip, and the sheet S is pressed under heating in the fixing nip. The toner particles forming the toner image on the sheet S are heated and the crystalline resin in the toner particles is quickly melted. As a result, all the toner particles are melted by a relatively small amount of heat, and the toner components adhere onto the sheet S. The toner image is quickly fixed onto the sheet S by a relatively small amount of heat. The sheet S having the fixed toner image is discharged to the outside of the apparatus through the sheet discharger 52 including a sheet discharging roller 52*a*. A high-quality image is thereby formed.

After the secondary transfer, the residual toner on the surface of the intermediate transfer belt 421 is removed with the belt cleaning unit 426 including a belt cleaning blade which slides on the surface of the intermediate transfer belt 421.

The above-mentioned embodiments should not be construed to limit the present invention and may be appropriately modified within the scope of the present invention.

EXAMPLES

The present invention will now be described in detail by way of non-limiting Examples. In Examples, "parts" and "%" are on the mass basis, unless otherwise specified.

[Preparation of Toner Particles [1]]

<Preparation of External Additive>

Silica particles A, Silica particles B, and titanium oxide nanoparticles were prepared as external additives (particles). The number average diameter, average circularity, and average aspect ratio of primary particles of each external additive were measured as follows.

(Measurement of Number Average Primary-Particle Diameter)

A photographic image taken with a scanning electron microscope (SEM) "JSM-7401F" (made by JEOL, Ltd.) was read with a scanner, and the external additive particles (silica particles) in the photographic image were binarized with an image analyzer LUZEX AP (made by NIRECO CORPORATION). The horizontal Feret diameters of 100 external additive particles (silica particles) were calculated, and the average was defined as a number average primary-particles diameter.

(Measurement of Average Circularity)

A photographic image taken with a scanning electron microscope (SEM) "JSM-7401F" (made by JEOL, Ltd.) was read in with a scanner, and the external additive particles (silica particles) in the photographic image were binarized with an image analyzer LUZEX AP (made by NIRECO CORPORATION). The circularities of 100 external additive particles (silica particles) were determined from the following expression, and the average circularity was calculated:

$$\text{Circularity}=(\text{circle equivalent perimeter of particle})/(\text{perimeter of particle})=[2\times(A\pi)^{1/2}]/PM$$

where A represents the projected area of a silica particle, and PM represents the perimeter of the silica particle. The average circularity is defined as a 50% circularity in cumulative frequency of the circularities of the 100 silica particles determined by the plane-image analysis.

(Measurement of Average Aspect Ratio of Titanium Oxide Nanoparticles)

The major diameters (maximum diameters if the nanoparticles were almost spherical) and minor diameters (minimum diameters if the nanoparticles were almost spherical) of titanium oxide nanoparticles in an electron microscopic photograph were measured with a scanning electron microscope (SEM) "JSM-7401F" (made by JEOL, Ltd.). The average of the major diameters and that of the minor diameters at n=20 were defined as the number average major diameter and the number average minor diameter, respectively.

Using the number average major diameter and the number average minor diameter determined by the procedure above, the average aspect ratio was calculated from the following expression:

$$\text{Average aspect ratio}=(\text{number average major diameter})/(\text{number average minor diameter})$$

<Preparation of External Additive: Preparation of Silica Particles [A1]>

Pure water (347.4 g) was placed in a conical flask. Tetramethoxysilane (TMOS) (110 g) was added under stirring, and was stirred for one hour to prepare a hydrolytic solution (457.4 g) of TMOS.

In the next step, pure water (2250 g) and ethylenediamine (112 g) were placed in a 3-L reactor provided with a stirrer, a dropping funnel, and a thermometer. The solution was kept at a temperature of 35° C., and a half (228.7 g) of the total amount of the hydrolytic solution of TMOS was added at 2.5 mL/min with stirring.

After completion of addition of the hydrolytic solution of TMOS, the solution was kept in this state for 30 minutes, and an aqueous solution (4.5 g) of 1 mmol/g ethylenediamine was added to adjust the pH to 8 (35° C.).

In the subsequent step, while an alkali catalyst (aqueous solution of 1 mmol/g ethylenediamine) was appropriately added so as to keep the pH at 8 (35° C.), the remaining hydrolytic solution of TMOS was added at a rate of 2.5 mL/min for every three hours. This operation was continued, and 457.4 g of the hydrolytic solution of TMOS in total was added.

The hydrolytic condensation reaction was continued with stirring for further 0.5 hours after completion of addition of the hydrolytic solution of TMOS to prepare a solution of hydrophilic spherical silica particles in a mixture of water and ethylenediamine. The silica particles had a number average primary-particle diameter of 86 nm and an average circularity of 0.83.

(Surface Modification)

In the next step, a solution of ethanol (50 parts by mass) and dimethylsilicone oil (20 parts by mass) was prepared, and was sprayed onto the silica particles (number average primary-particle diameter of 86 nm) by spray drying to modify the surfaces of the silica particles. The silica particles were then heated to 80° C. to remove ethanol by drying, and were further surface-modified while stirring was being performed at 250° C. for two hours. The surface-modified silica particles were then added to ethanol. The solution was stirred to separate free oil. The product was then dried to yield Silica particles [A1].

<Preparation of External Additive: Preparation of Silica Particles [A2] to [A14]>

Silica particles [A2] to [A11] were prepared as in Silica particles [A1] except that the amount of the tetramethoxysilane (TMOS) added in preparation of the hydrolytic solution of TMOS (110 g), the amount of ethylenediamine placed in the 3-L reactor (112 g), and the addition rate of the hydrolytic solution of TMOS (2.5 mL/min) were varied as shown in Table 1.

Silica particles [A12] were prepared as in preparation of Silica particles [A1] except that the "dimethylsilicone oil" used in surface modification was replaced with "alkyl-modified silicone oil (product name: X-22-1877, made by Shin-Etsu Chemical Co., Ltd.)".

Silica particles [A13] were prepared as in preparation of Silica particles [A1] except that the "dimethylsilicone oil" used in surface modification was replaced with "amino-modified silicone oil (product name: KF-865, made by Shin-Etsu Chemical Co., Ltd., viscosity (25° C.): 110 $mm^2/s$, functional group equivalent: 5000 g/mol)".

Silica particles [A14] were prepared as in preparation of Silica particles [A1] except that the "dimethylsilicone oil" used in surface modification was replaced with "hexamethyldisilazane (HMDS)".

In Silica particles [A2] to [A14], the number average primary-particle diameter (nm) and the average circularity were determined as in Silica particles [A1]. The results are shown in Table 1.

TABLE 1

| No. | Hydrolytic solution of TMOS Amount of TMOS added [g] | Amount added to 3 L reactor Ethylenediamine [g] | Addition rate of TMOS [mL/min] | Number average primary'"particle diameter [nm] | Average circularity | Surface modifier |
|---|---|---|---|---|---|---|
| A1 | 110 | 112 | 2.5 | 86 | 0.83 | Dimethylsilicone |
| A2 | 30 | 112 | 2.5 | 36 | 0.83 | Dimethylsilicone |
| A3 | 38 | 112 | 2.5 | 40 | 0.83 | Dimethylsilicone |
| A4 | 55 | 112 | 2.5 | 55 | 0.83 | Dimethylsilicone |
| A5 | 175 | 112 | 2.5 | 100 | 0.83 | Dimethylsilicone |
| A6 | 310 | 112 | 2.5 | 117 | 0.83 | Dimethylsilicone |
| A7 | 110 | 80 | 1.7 | 84 | 0.46 | Dimethylsilicone |
| A8 | 110 | 94 | 1.9 | 85 | 0.50 | Dimethylsilicone |
| A9 | 110 | 105 | 2.3 | 88 | 0.76 | Dimethylsilicone |
| A10 | 110 | 115 | 3.0 | 86 | 0.90 | Dimethylsilicone |
| A11 | 110 | 124 | 3.3 | 88 | 0.92 | Dimethylsilicone |
| A12 | 110 | 112 | 2.5 | 86 | 0.83 | Alkyl-modified silicone |
| A13 | 110 | 112 | 2.5 | 86 | 0.83 | Amino-modified silicone |
| A14 | 110 | 112 | 2.5 | 86 | 0.83 | HMDS |

<Preparation of External Additive: Preparation of Silica Particles [B1]>

Silica particles before surface modification were prepared as in "Preparation of Silica particles [A1]" described above except that "347.4 g of pure water and 110 g of tetramethoxysilane (TMOS)" added in preparation of the hydrolytic solution of TMOS were replaced with "35 g of pure water and 30 g of tetramethoxysilane (TMOS)", "112 g of ethylenediamine" placed in the 3-L reactor was replaced with "140 g of ethylenediamine", and the rate of addition ("2.5 mL/min") of the hydrolytic solution of TMOS was changed to "4.5 mL/min". The silica particles before surface modification had a diameter (number average primary particle diameter) of 36 nm.

In the next step, 100 parts by mass of the silica particles (number average primary-particle diameter: 36 nm) was placed in a reactor, and pure water (3.0 parts by mass) was sprayed onto the silica particles with stirring under a nitrogen atmosphere. Surface modifiers n-octyltrimethoxysilane (10 parts by mass) and diethylamine (1.0 part by mass) were then sprayed onto the silica particles. The silica particles were heated at 180° C. for one hour with stirring, were cooled, and were dried under reduced pressure to yield Silica particles [B1].

<Preparation of External Additive: Preparation of Silica Particles [B2] to [B15]>

Silica particles [B2] to [B7] were prepared as in preparation of Silica particles [B1] except that the amount of tetramethoxysilane (TMOS) added in preparation of the hydrolytic solution of TMOS was varied as shown in Table 2.

Silica particles [B8] were prepared as in preparation of Silica particles [B1] except that the surface modifier "n-octyltrimethoxysilane" used in surface modification was replaced with "ethyltrimethoxysilane".

Silica particles [B9] were prepared as in preparation of Silica particles [B1] except that the surface modifier "n-octyltrimethoxysilane" used in surface modification was replaced with "n-butyltrimethoxysilane".

Silica particles [B10] were prepared as in preparation of Silica particles [B1] except that the surface modifier "n-octyltrimethoxysilane" used in surface modification was replaced with "(2,4,4-trimethylpentyl)trimethoxysilane".

Silica particles [B11] were prepared as in preparation of Silica particles [B1] except that the surface modifier "n-octyltrimethoxysilane" used in surface modification was replaced with "n-octyltriethoxysilane".

Silica particles [B12] were prepared as in preparation of Silica particles [B1] except that the surface modifier "n-octyltrimethoxysilane" used in surface modification was replaced with "hexamethyldisilazane (HMDS)".

Silica particles [B13] were prepared as in preparation of Silica particles [B1] except that the surface modifier "n-octyltrimethoxysilane" used in surface modification was replaced with "hexaethyldisilazane (HEDS)".

Silica particles [B14] were prepared as in preparation of Silica particles [B1] except that the surface modifier "n-octyltrimethoxysilane" used in surface modification was replaced with "n-decyltrimethoxysilane".

Silica particles [B15] were prepared as in preparation of Silica particles [B1] except that the surface modifier "n-octyltrimethoxysilane" used in surface modification was replaced with "n-dodecyltrimethoxysilane".

The number average diameters (nm) of primary Silica particles B [B2] to [B15] are shown in Table 2.

In Table 2, $R_1$ and $R_2$ in alkoxysilane correspond to $R_1$ and $R_2$ in Formula (1), respectively:

$$R_1—Si(OR_2)_3 \qquad \text{Formula (1)}$$

TABLE 2

| No. | Hydrolytic solution of TMOS: Amount of TMOS added [g] | Amount added to 3 L reactor: Ethylenediamine [g] | Addition rate of TMOS [mL/min] | Number average primary'"particle diameter [nm] | Surface modifier: Alkylalkoxysilane: Alkoxysilane | Carbon atoms in $R_1$ | $R_2$ | Silazane |
|---|---|---|---|---|---|---|---|---|
| B1 | 30 | 140 | 4.5 | 36 | n-Octyltrimethoxysilane | 8 | Methyl group | — |
| B2 | 20 | 140 | 4.5 | 20 | n-Octyltrimethoxysilane | 8 | Methyl group | — |
| B3 | 25 | 140 | 4.5 | 25 | n-Octyltrimethoxysilane | 8 | Methyl group | — |
| B4 | 50 | 140 | 4.5 | 47 | n-Octyltrimethoxysilane | 8 | Methyl group | — |
| B5 | 70 | 140 | 4.5 | 68 | n-Octyltrimethoxysilane | 8 | Methyl group | — |
| B6 | 145 | 140 | 4.5 | 86 | n-Octyltrimethoxysilane | 8 | Methyl group | — |
| B7 | 175 | 140 | 4.5 | 96 | n-Octyltrimethoxysilane | 8 | Methyl group | — |
| B8 | 30 | 140 | 4.5 | 36 | Ethyltrimethoxysilane | 2 | Methyl group | — |
| B9 | 30 | 140 | 4.5 | 36 | n-Butyltrimethoxysilane | 4 | Methyl group | — |
| B10 | 30 | 140 | 4.5 | 36 | (2,4,4-Trimethylpentyl) trimethoxysilane | 8 | Methyl group | — |
| B11 | 30 | 140 | 4.5 | 36 | n-Octyltrimethoxysilane | 8 | Ethyl group | — |
| B12 | 30 | 140 | 4.5 | 36 | — | — | — | HMDS |
| B13 | 30 | 140 | 4.5 | 36 | — | — | — | HEDS |
| B14 | 30 | 140 | 4.5 | 36 | n-Decyltrimethoxysilane | 10 | Methyl group | — |
| B15 | 30 | 140 | 4.5 | 36 | n-Dodecyltrimethoxysilane | 12 | Methyl group | — |

<Preparation of External Additive: Preparation of Titanium Oxide Nanoparticles [1]>

Methanol (500 parts by mass) was stirred in a 1-L reactor provided with a stirrer, a dropping funnel, and a thermometer. Titanium isopropoxide (10 parts by mass) was added dropwise, and was continuously stirred for 15 minutes. The resulting titanium oxide nanoparticles were then centrifugally separated, were recovered, and were dried under reduced pressure to yield amorphous titanium oxide. The amorphous titanium oxide was heated at 800° C. for five hours in the air in a high temperature electric furnace to yield rutile titanium oxide nanoparticles. The rutile titanium oxide nanoparticles (100 parts by mass) and isobutyltrimethoxsilane (15 parts by mass) were placed in the 3-L reactor provided with a stirrer, a dropping funnel, and a thermometer, and were stirred in toluene for ten hours to hydrophobize the surfaces of the rutile titanium oxide nanoparticles. The reaction product was then centrifugally washed to remove the reaction solvent and was centrifugally recovered. The product was dried under reduced pressure to yield rutile Titanium oxide nanoparticles [1] having an average aspect ratio of 8.5.

<Preparation of Dispersion of Colorant Nanoparticles [Bk]>

Sodium n-dodecylsulfate (90 parts by mass) was dissolved in deionized water (1600 parts by mass) with stirring. The solution was gradually added to carbon black "MOGUL L" (made by Cabot Corporation, pH: 2) (420 parts by mass) with stirring, and was dispersed with a stirrer "Cleamix" (made by M Technique Co., Ltd.) to prepare a dispersion of Colorant nanoparticles [Bk] containing the carbon black particles. The diameters of Colorant nanoparticles [Bk] in the dispersion were measured with a microtrack particle size distribution analyzer "UPA-150" (made by NIKKISO CO., LTD.). Colorant nanoparticles [Bk] had a volume-based median diameter of 85 nm.

<Preparation of Crystalline Polyester Resin [1]>

A mixed solution of 1,9-nonanediol (300 g), dodecanedioic acid (250 g), a catalyst $Ti(OBu)_4$ (0.014 mass % relative to carboxylic acid monomer) was placed in a three-necked flask, and the container was depressurized. The three-necked flask was purged with gaseous nitrogen to provide an inert atmosphere in the flask. The mixed solution was refluxed at 180° C. for six hours while being mechanically stirred. Subsequently, the unreacted monomer component was removed through distillation under reduced pressure. The product was gradually heated to 220° C., and was stirred for 12 hours. When the product became viscous, the product was cooled to yield Crystalline polyester resin [1]. Crystalline polyester resin [1] had a weight average molecular weight (Mw) of 19500 and a melting point of 75° C. The weight average molecular weight (Mw) and the melting point were measured as follows.

(Measurement of Molecular Weight)

The molecular weight was determined with a gel permeation chromatograph "HLC-8220" (made by Tosoh Corporation) provided with three columns of "TSKguard column+ TSKgel SuperHZM-M" (made by Tosoh Corporation).

While the column temperature was kept at 40° C., a carrier solvent tetrahydrofuran (THF) was fed through the columns at a flow rate of 0.2 mL/min. A sample solution (10 μL) was injected into the apparatus to measure the refractive index with a refractive index detector (RI detector). The molecular weight distribution of the sample was determined through calculation using a calibration curve determined with monodispersed standard polystyrene beads.

(Measurement of Melting Point of Crystalline Resin)

The melting point of the crystalline resin was determined with a differential scanning calorimeter "diamond DSC" (made by PerkinElmer Inc.) as follows: A sample (3.0 mg) was sealed in an aluminum pan, and was placed on a sample holder. An empty aluminum pan was placed on a reference holder. The sample was sequentially subjected to a first heating cycle to heat the sample from 0° C. to 200° C. at a heating rate of 10° C./min, a cooling cycle to cool the sample from 200° C. to 0° C. at a cooling rate of 10° C./min, and a second heating cycle to heat the sample from 0° C. to 200° C. at a heating rate of 10° C./min to produce a DSC curve. Based on the DSC curve, the endothermic peak temperature derived from the crystalline polyester in the first heating cycle was defined as the melting point of the crystalline polyester.

<Preparation of Dispersion of Resin Nanoparticles [L3] for Core>

A dispersion of resin nanoparticles (Resin nanoparticles (L3) for a core) containing binder resin nanoparticles dispersed inside the resin nanoparticles was prepared through the following first to third polymerization stages.

(1) Preparation of Dispersion of Resin Particles [L1] (First Polymerization)

Sodium polyoxyethylene(2) dodecyl ether sulfate (4 g) and deionized water (3000 g) were placed in a 5-L reaction container equipped with a stirrer, a temperature sensor, a cooling tube, and a nitrogen inlet, and the mixed solution was heated to 80° C. while being stirred at a stirring rate of 230 rpm under a nitrogen stream. After the heating, a solution of potassium persulfate (10 g) in deionized water (200 g) was added to the mixed solution, and the solution was heated to 75° C. A solution of mixed monomers having the following composition was added dropwise to the solution over one hour. The mixed solution was then heated at 75° C. for two hours with stirring to polymerize the monomers. A dispersion of Resin particles [L1] was thereby prepared.

Styrene: 568 g
n-Butyl acrylate: 164 g
Methacrylic acid: 68 g (2) Preparation of Dispersion of Resin Particles [L2] (Second Polymerization)

A solution of sodium polyoxyethylene(2) dodecyl ether sulfate (2 g) in deionized water (3000 g) was placed in a 5-L reaction container equipped with a stirrer, a temperature sensor, a cooling tube, and a nitrogen inlet, and the mixed solution was heated to 80° C.

The monomers in the following composition were dissolved at 80° C. to prepare a monomer solution:

Resin particles [L1]: 42 g
(in terms of solid content)
Behenyl behenate: 70 g
Crystalline polyester resin [1]: 70 g
Styrene: 195 g
n-Butyl acrylate: 91 g
Methacrylic acid: 20 g
n-Octylmercaptan: 3 g The monomer solution was then added to the mixed solution, and was dispersed for one hour with a mechanical dispersing machine "CLEARMIX" (made by M Technique Co., Ltd.) having a circulation path to prepare a dispersion containing emulsified particles (oil droplets). In the next step, potassium persulfate (5 g) was dissolved in deionized water (100 g) to prepare an initiator solution, and the initiator solution was added to the dispersion. The dispersion was heated at 80° C. over one hour with stirring to polymerize the monomers. A dispersion of Resin particles [L2] was thereby prepared.

(3) Preparation of Dispersion of Resin Nanoparticles [L3] for Core (Third Polymerization)

A solution of potassium persulfate (10 g) in deionized water (200 g) was further added to the dispersion of Resin particles [L2]. The dispersion was kept at 80° C., and a solution of mixed monomers having the following composition was added dropwise to the dispersion over one hour. After the addition, the dispersion was heated over two hours with stirring to polymerize the monomers, and was cooled to 28° C. to prepare a dispersion of Resin nanoparticles [L3] for a core.

Styrene: 298 g
n-Butyl acrylate: 137 g
n-Stearyl acrylate: 50 g
Methacrylic acid: 64 g
n-Octylmercaptan: 6 g <Preparation of Dispersion of Resin Nanoparticles [S1] for Shell>

A surfactant solution of polyoxyethylene dodecyl ether sodium sulfate (2.0 g) in deionized water (3000 g) was placed in a reaction container equipped with a stirrer, a temperature sensor, a cooling tube, and a nitrogen inlet. The solution was heated to 80° C. while being stirred at a stirring rate of 230 rpm under a nitrogen stream. An initiator solution of potassium persulfate (10 g) in deionized water (200 g) was mixed with the solution. A mixed monomer solution having the following composition was added dropwise to the mixed solution over three hours. The mixed solution was then heated at 80° C. over one hour with stirring to polymerize the monomers. A dispersion of Resin nanoparticles [S1] for a shell was thereby prepared.

Styrene: 564 g
n-Butyl acrylate: 140 g
Methacrylic acid: 96 g
n-Octylmercaptan: 12 g <Preparation of Core-Shell Particles [1] (Aggregation and Fusion)>

The dispersion of Resin nanoparticles [L3] for a core (solid content: 360 g), deionized water (1100 g), and the dispersion (40 g) of Colorant nanoparticles [Bk] were placed in a 5-L reaction container equipped with a stirrer, a temperature sensor, a cooling tube, and a nitrogen inlet. The temperature of the dispersion was adjusted to 30° C., and an aqueous solution of 5 N sodium hydroxide was added to the dispersion to adjust the pH of the dispersion to 10. In the next step, an aqueous solution of magnesium chloride (60 g) in deionized water (60 g) was added dropwise to the dispersion at 30° C. over ten minutes under stirring. After addition, the dispersion was kept at 30° C. for three minutes, and then heating was started. The dispersion was heated to 85° C. over 60 minutes. A particle growth reaction was continued while the temperature of the dispersion was kept at 85° C. A dispersion of Core particles [1] was thereby prepared. Resin nanoparticles [S1] for a shell (solid content: 80 g) were added to the dispersion, and were continuously stirred at 80° C. over one hour to fuse Resin nanoparticles

[S1] for a shell onto the surfaces of Core particles [1]. A shell layer was thereby formed to prepare Resin particles [1]. An aqueous solution of sodium chloride (150 g) in deionized water (600 g) was added to the dispersion. The dispersion was aged at a solution temperature of 80° C. When the average circularity of Resin particles [1] reached 0.960, the dispersion was cooled to 30° C. to prepare Core-shell particles [1]. Core-shell particles [1] after cooling had a number-based median diameter of 5.5 μm.

<Measurement of Number-Based Median Diameter of Particulate Toner Matrix>

The number-based median diameter of the particulate toner matrix represents a median particle diameter of a number particle diameter distribution, and can be measured and calculated with an apparatus "Multisizer 3 (made by Beckman Coulter, Inc.)" connected to a computer system for data processing.

The measurement was performed by the following procedure: Toner particles (0.02 g) were mixed with a surfactant solution (20 mL) (such as a surfactant solution for dispersing a particulate toner matrix which contained a neutral detergent containing a surfactant component diluted ten fold with pure water), and were ultrasonically dispersed for one minute to prepare a dispersion of a particulate toner matrix. The dispersion of a particulate toner matrix was injected with a pipette into a beaker containing ISOTONII (made by Beckman Coulter, Inc.) on a sample stand until the concentration reached 5 to 10%. This range of concentration allows measurement with reproducibility. The count of the particles to be measured was set to 25000, and the aperture diameter of Multisizer 3 (made by Beckman Coulter, Inc.) was set at 100 μm. The range of 1 to 30 μm for measurement was divided into 256 to calculate the number per frequency. A 50% particle diameter from the largest number integration fraction was defined as a number-based median diameter.

<Average Circularity of Particulate Toner Matrix>

The average circularity of the particulate toner matrix was measured with a flow particle image analyzer "FPIA-3000" (made by SYSMEX CORPORATION). Specifically, the particulate toner matrix was moistened with an aqueous surfactant solution, and was ultrasonically dispersed for one minute. The particulate toner matrix was measured with a "FPIA-3000" in a high power field (HPF) mode at an appropriate density (the number of particles to be detected at an HPF: 3000 to 10000 particles). This range allows measurement with reproducibility. The circularity was calculated from the following expression:

Circularity of particulate toner matrix=(perimeter of a circle having a projected area identical to that of the projected image of a particle)/(perimeter of the projected image of the particle)

In this specification, the average circularity represents the arithmetic average determined by dividing the sum of the circularities of the particles by the total number of particles measured.

<Preparation of Particulate Toner Matrix [1] (Washing and Drying)>

The dispersion of Core-shell particles [1] prepared through the aggregation and fusion steps was subjected to solid liquid separation with a centrifuge to yield wet cake of Core-shell particles [1]. The wet cake was centrifugally washed with deionized water at 35° C. until the electric conductivity of the filtrate reached 5 μS/cm. The wet cake was then placed in a "flash jet dryer" (made by Seishin Enterprise Co., Ltd.), and was dried until the moisture content reached 0.8 mass %. Particulate toner matrix [1] was thereby prepared.

<Preparation of Toner Particles [1] (External Addition)>

The following external additive particles were added to Particulate toner matrix [1] in a Henschel mixer "FM20C/I" (made by NIPPON COKE & ENGINEERING CO., LTD.), and were stirred for 15 minutes with a blade at a rotational frequency, i.e., a circumferential rate of 40 m/s at the distal end. Toner particles [1] were thereby prepared.

Silica particles [A1]: 1.0 part by mass

Silica particles [B1]: 1.0 part by mass

Titanium oxide nanoparticles [1]: 0.5 parts by mass

The mixing temperature for the external additive particles and Toner particles [1] was set to be 40° C.±1° C. The internal temperature of the Henschel mixer was controlled with cooling water at a flow rate of 5 L/min through an external bath of the Henschel mixer if the temperature reached 41° C., and with cooling water at a flow rate of 1 L/min through the external bath if the temperature reached 39° C.

[Preparation of Developer [1]]

<Preparation of Resin for Coating Core Material (Coating Material [1])>

Cyclohexyl methacrylate and methyl methacrylate (molar ratio of 1:1) were added to an aqueous 0.3 mass % sodium benzenesulfonate solution, and potassium persulfate (0.5 mass % of the total monomer amount) was added to perform emulsion polymerization. The resin particles in the dispersion were spray dried to prepare a resin for coating a core material, i.e., Coating material [1]. Coating material [1] had a weight average molecular weight (Mw) of 500000. The weight average molecular weight (Mw) of Coating material [1] was determined by gel permeation chromatography (GPC) as in Crystalline polyester resin [1] described above.

<Preparation of Carrier Particles [1]>

Mn—Mg ferrite particles having a volume average diameter of 30 μm were prepared as core particles. The ferrite particles (100 parts by mass) and Coating material [1] (4.5 parts by mass) were placed in a high-rate stirring mixer with a horizontal stirring blade, and were mixed at 22° C. for 15 minutes with a horizontal rotary blade at a circumferential speed of 8 m/sec. In the next step, these materials were mixed at 120° C. for 50 minutes to coat the surfaces of the core particles with Coating material [1] by the action of mechanical impact (mechanochemical process). Carrier particles [1] were thereby prepared. Carrier particles [1] had a volume-based median diameter of 34 μm.

(Measurement of Volume-Based Median Diameter of Carrier Particles)

The volume-based median diameter of magnetic particles was measured by a wet process with a laser diffraction particle diameter distribution analyzer "HELOS KA" (available from Japan Laser Corporation). Specifically, an optical system having a focal position of 200 mm was selected, and the measurement time was set at five seconds. The magnetic particles to be measured were added to an aqueous 0.2% sodium dodecylsulfate solution, and were dispersed for three minutes with an ultrasonic washer "US-1" (made by AS ONE Corporation) to prepare a dispersion sample for measurement. Several drops of the dispersion sample were fed into "HELOS KA". When the concentration of the dispersion sample reached the measureable range, the measurement was started. From the resulting particle diameter distribution, a cumulative distribution was prepared from a smaller diameter in the measured diameter range (channel), and the cumulative 50% particle diameter was defined as the volume-based median diameter.

<Preparation of Developer [1]>

Toner particles [1] and Carrier particles [1] were mixed with a V-type mixer for 30 minutes such that the resulting two-component developer contained 6 mass % of toner particles (toner content). Two-component Developer [1] was thereby prepared.

[Preparation of Toner Particles [2] to [28] and Developers [2] to [28]]

Toner particles [2] to [28] were prepared as in preparation of Toner particles [1] except that the types of Silica particles A and Silica particles B were varied as shown in Table 3.

Developers [2] to [28] were prepared as in preparation of Developer [1] except that Toner particles [1] were replaced with Toner particles [2] to [28].

<Evaluation>

An apparatus for evaluation used was a commercially available digital full-color multifunctional machine "bizhub PRESS 1070" (made by KONICA MINOLTA, INC., "bizhub" is a registered trademark of the company). The two-component developers were each charged into the apparatus to perform the following evaluations.

The apparatus for evaluation performs printing by a process of forming electrophotographic images including a discharging step, an exposing step, a developing step, and a transfer step. The evaluations were performed with the apparatus for evaluation illustrated in FIG. 1, involving the transfer step including a primary transfer substep of transferring a toner image from an electrostatic latent image carrier (photoreceptor drum 413) onto an intermediate transfer member (intermediate transfer belt 421), and a secondary transfer substep of transferring the toner image on the intermediate transfer member (intermediate transfer belt 421) onto a transfer material (sheet S).

The following evaluations about "transfer characteristics to embossed paper" and "graininess" were performed on the apparatus for evaluation at an initial printing stage (0 sheets) and after durability printing of 100000 sheets. In the specification, "durability printing of 100000 sheets" indicates printing of a character chart having a coverage rate of 5% on 100000 sheets under an environment at 20° C. and 50% RH.

(Transfer Characteristics to Embossed Paper)

The transfer rate of a solid image to embossed paper (trade name: LEATHAC 66, made by Tokushu Tokai Paper Co., Ltd., basis weight: 203 g/m$^2$, maximum depth of depressed portions from paper surface: 100 to 150 μm) was evaluated in the apparatus for evaluation at the initial printing stage (0 sheets) and after durability printing of 100000 sheets to evaluate the transfer characteristics to embossed paper.

The transfer rate was calculated as follows: The developing bias was controlled such that 4 g/m$^2$ of toner adhered onto the transfer belt during printing of the solid image. The density (g/m$^2$) of the toner adhering onto the embossed paper after secondary transfer was measured. The transfer rate was calculated from the following expression:

Transfer rate (%)=((density (g/m$^2$) of toner adhering onto embossed paper)/(density (g/m$^2$) of toner adhering onto transfer belt))×100

The transfer rate was evaluated according to the following criteria. A transfer rate of 90% or more in the apparatus for evaluation at the initial printing stage and after durability printing was determined as a practical or acceptable level.

□: A transfer rate of 95% or more

○: A transfer rate of 90% or more and less than 95% x: A transfer rate of less than 90%

(Graininess)

An image having a gradation pattern of 32 gradations was output in the apparatus for evaluation at an initial printing stage (0 sheets) and after durability printing of 100000 sheets. The graininess of the image was evaluated as follows: The gradation pattern was read in with a CCD, and the read value was subjected to Fourier transform in consideration of modulation transfer function (MTF) correction. The graininess index (GI) according to the human luminosity function was measured, and the maximum GI was determined. A smaller GI indicates lower graininess of the image. The GI is described in The Journal of The Imaging Society of Japan 39(2), 84.93 (2000). The graininess of the gradation pattern of the image was evaluated in the apparatus for evaluation at the initial printing stage (0 sheets) and after durability printing of 100000 sheets according to the following criteria for evaluation. In the following criteria, " " or "○" indicates an acceptable level.

The images having a gradation pattern output at the initial stage and after durability printing were evaluated based on the maximum GI of the image according to the following criteria:

: maximum GI of less than 0.23

○: maximum GI of 0.23 or more and less than 0.26 x: maximum GI of 0.26 or more

The images were also evaluated based on the difference (ΔGI) in maximum GI between the initial stage and after durability printing according to the following criteria:

: ΔGI of 0 or more and less than 0.020

○: ΔGI of 0.020 or more and less than 0.040 x: ΔGI of 0.040 or more (Cleaning Characteristics: Evaluation about no Generation of Image Defects Attributed to Escape of External Additive)

A test image having five solid stripe images each having a width of 3 cm was continuously printed onto 100000 sheets of high quality paper (65 g/m$^2$) of size A4 (durability printing), and then an entire solid image was output. The image density was measured in six portions in total in the output solid image, i.e., five stripe portions and one non-stripe portion corresponding to the durability printing with a reflection densitometer "RD-918" made by Gretag Macbeth GmbH. The maximum difference in image density was calculated from the following expression:

Maximum difference in image density=(the highest image density among the image densities of five portions corresponding to stripes in the durability printing)−(the image density of the non-stripe portion)

Based on the calculated maximum difference in image density, a maximum difference in image density of 0.06 or less was determined as a practical or acceptable level according to the following criteria:

In this evaluation, a smaller maximum difference in image density indicates higher cleaning characteristics and no generation of image defects attributed to escape of external additive.

□: maximum difference in image density of 0.03 or less

○: maximum difference in image density of more than 0.03 and 0.06 or less x: maximum difference in image density of more than 0.06

The results of evaluation are shown in Table 3 below. "Initial stage" indicates the results of evaluation performed using the apparatus for evaluation at the initial printing stage (0 sheets). "After durability test" indicates the results of evaluation performed using the apparatus for evaluation after durability printing of 100000 sheets.

TABLE 3

| | | | Evaluation | | | | | | | | | | | | |
|---|---|---|---|---|---|---|---|---|---|---|---|---|---|---|---|
| | | | Transfer characteristics to embossed paper | | | | Graininess | | | | | | Cleaning characteristics | | |
| | | | Initial stage | | After durability test | | Initial stage | | After durability test | | Inital stage to after durability test | | | | |
| Toner No. | Silica particles A | Silica particles B | Transfer rate [%] | Rank | Transfer rate [%] | Rank | GI | Rank | GI | Rank | ΔGI | Rank | Maximum difference in density | Rank | Notes |
| 1 | A1 | B1 | 98 | ◎ | 96 | ◎ | 0.22 | ○ | 0.23 | ○ | 0.01 | ◎ | 0.02 | ◎ | Example |
| 2 | A2 | B1 | 88 | X | 81 | X | 0.23 | ○ | 0.26 | X | 0.03 | ○ | 0.07 | X | Comparative |
| 3 | A3 | B1 | 92 | ○ | 90 | ○ | 0.23 | ○ | 0.24 | ○ | 0.01 | ◎ | 0.04 | ○ | Example |
| 4 | A4 | B1 | 95 | ◎ | 93 | ○ | 0.22 | ◎ | 0.24 | ○ | 0.02 | ○ | 0.02 | ◎ | Example |
| 5 | A5 | B1 | 98 | ◎ | 97 | ◎ | 0.23 | ○ | 0.25 | ○ | 0.02 | ○ | 0.03 | ◎ | Example |
| 6 | A6 | B1 | 98 | ◎ | 97 | ◎ | 0.23 | ○ | 0.23 | X | 0.05 | X | 0.06 | ○ | Comparative |
| 7 | A7 | B1 | 91 | ○ | 90 | ○ | 0.26 | X | 0.25 | X | 0.00 | ◎ | 0.01 | ◎ | Comparative |
| 8 | A8 | B1 | 91 | ○ | 90 | ○ | 0.24 | ○ | 0.25 | ○ | 0.01 | ◎ | 0.01 | ◎ | Example |
| 9 | A9 | B1 | 95 | ◎ | 94 | ○ | 0.23 | ○ | 0.23 | ○ | 0.00 | ◎ | 0.01 | ◎ | Example |
| 10 | A10 | B1 | 98 | ◎ | 95 | ◎ | 0.22 | ◎ | 0.25 | ○ | 0.03 | ○ | 0.06 | ○ | Example |
| 11 | A11 | B1 | 99 | ◎ | 89 | X | 0.22 | ◎ | 0.27 | X | 0.05 | X | 0.11 | X | Comparative |
| 12 | A12 | B1 | 97 | ◎ | 95 | ◎ | 0.23 | ○ | 0.25 | ○ | 0.02 | ○ | 0.02 | ◎ | Example |
| 13 | A13 | B1 | 95 | ◎ | 95 | ◎ | 0.23 | ○ | 0.25 | ○ | 0.02 | ○ | 0.00 | ◎ | Example |
| 14 | A14 | B1 | 93 | ○ | 92 | ○ | 0.26 | X | 0.23 | X | 0.03 | ○ | 0.00 | ◎ | Comparative |
| 15 | A1 | B2 | 95 | ◎ | 96 | ◎ | 0.22 | ◎ | 0.27 | X | 0.05 | X | 0.01 | ◎ | Comparative |
| 16 | A1 | B3 | 97 | ◎ | 96 | ◎ | 0.22 | ◎ | 0.25 | ○ | 0.03 | ○ | 0.02 | ◎ | Example |
| 17 | A1 | B4 | 96 | ◎ | 95 | ◎ | 0.22 | ◎ | 0.29 | ○ | 0.01 | ◎ | 0.02 | ◎ | Example |
| 18 | A1 | B5 | 93 | ○ | 93 | ○ | 0.23 | ○ | 0.24 | ○ | 0.01 | ◎ | 0.00 | ◎ | Example |
| 19 | A1 | B6 | 86 | X | 82 | X | 0.24 | ○ | 0.25 | ○ | 0.01 | ◎ | 0.04 | ○ | Comparative |
| 20 | A1 | B7 | 77 | X | 73 | X | 0.24 | ○ | 0.26f | X | 0.02 | ○ | 0.08 | X | Comparative |
| 21 | A1 | B8 | 93 | ◎ | 97 | ◎ | 0.24 | ○ | 0.25 | ○ | 0.01 | ◎ | 0.01 | ◎ | Example |
| 22 | A1 | B9 | 98 | ◎ | 97 | ◎ | 0.23 | ○ | 0.25 | ○ | 0.02 | ○ | 0.03 | ◎ | Example |
| 23 | A1 | B10 | 97 | ◎ | 95 | ◎ | 0.23 | ○ | 0.24 | ○ | 0.01 | ◎ | 0.03 | ◎ | Example |
| 24 | A1 | B11 | 98 | ◎ | 95 | ◎ | 0.23 | ○ | 0.24 | ○ | 0.01 | ◎ | 0.03 | ◎ | Example |
| 25 | A1 | B12 | 95 | ◎ | 95 | ◎ | 0.24 | ○ | 0.25 | ○ | 0.01 | ◎ | 0.02 | ◎ | Example |
| 26 | A1 | B13 | 95 | ◎ | 95 | ◎ | 0.24 | ○ | 0.25 | ○ | 0.01 | ◎ | 0.02 | ◎ | Example |
| 27 | A1 | B14 | 95 | ◎ | 94 | ○ | 0.24 | ○ | 0.25 | ○ | 0.01 | ◎ | 0.03 | ◎ | Example |
| 28 | A1 | B15 | 92 | ○ | 86 | X | 0.25 | ○ | 0.26 | X | 0.01 | ◎ | 0.05 | ○ | Comparative |

Table 3 demonstrates that the toners according to Examples achieve high transfer characteristics to embossed paper, can output images having high graininess, and can reduce generation of image defects attributed to escape of external additive particles even after the continuous printing of images having a high coverage rate. In contrast, the toners according to Comparative Examples are inferior in all the evaluation items.

Although embodiments of the present invention have been described and illustrated in detail, it is clearly understood that the same is by way of illustration and example only and is not to be taken by way of limitation, and the scope of the present invention should be interpreted by terms of the appended claims.

What is claimed is:

1. An electrostatically charged image developing toner comprising a particulate toner matrix containing an external additive on the surface of the particulate toner matrix, wherein the external additive comprises silica particles A and silica particles B, the silica particles A have a number average primary-particle diameter in the range of 40 to 100 nm and an average circularity in the range of 0.50 to 0.90, and are surface-modified with silicone oil, and the silica particles B have a number average primary-particle diameter of 36 nm or more and smaller than the number average primary-particle diameter of the silica particles A, and are surface-modified with alkylalkoxysilane having a structure represented by Formula (1) or silazane:

$$R_1—Si(OR_2)_3 \qquad \text{Formula (1)}$$

where $R_1$ represents a linear alkyl group having 1 or more and 10 or less carbon atoms and has an optional substituent; $R_2$ represents a methyl or ethyl group.

2. The electrostatically charged image developing toner according to claim 1, wherein the silica particles B are surface-modified with alkylalkoxysilane having a structure represented by Formula (1), and $R_1$ in Formula (1) has 4 or more and 8 or less carbon atoms.

3. The electrostatically charged image developing toner according to claim 1, wherein the silica particles B are surface-modified with the silazane, and the silazane contained is hexamethyldisilazane or hexaethyldisilazane.

4. The electrostatically charged image developing toner according to claim 1, wherein the external additive further comprises titanium oxide nanoparticles having an average aspect ratio in the range of 2 to 15, the average aspect ratio being a ratio of a number average major diameter to a number average minor diameter.

5. The electrostatically charged image developing toner according to claim 4, wherein the titanium oxide nanoparticles have a rutile crystal structure.

6. The electrostatically charged image developing toner according to claim 1, wherein the particulate toner matrix comprises a binder resin containing at least a crystalline resin.

7. The electrostatically charged image developing toner according to claim 1, wherein the silicone oil is dimethylsilicone oil.

8. The electrostatically charged image developing toner according to claim 1, wherein the particulate toner matrix contains an amorphous vinyl resin.

9. The electrostatically charged image developing toner according to claim 6, wherein the crystalline resin contains a crystalline polyester resin.

10. The electrostatically charged image developing toner according to claim 1, wherein the average circularity of the silica particles A is in the range of 0.50 to 0.83.

11. An electrostatically charged image developing two-component developer, comprising the electrostatically charged image developing toner according to claim 1 and carrier particles.

* * * * *